US010311786B2

(12) United States Patent
Oh et al.

(10) Patent No.: US 10,311,786 B2
(45) Date of Patent: Jun. 4, 2019

(54) LIGHT EMITTING DISPLAY DEVICE

(71) Applicant: SAMSUNG DISPLAY CO., LTD., Yongin-si, Gyeonggi-do (KR)

(72) Inventors: Wonsik Oh, Seoul (KR); Myungho Lee, Anyang-si (KR); Geunjeong Park, Hwaseong-si (KR); Myoungseop Song, Asan-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/707,083

(22) Filed: Sep. 18, 2017

(65) Prior Publication Data

US 2018/0090067 A1 Mar. 29, 2018

(30) Foreign Application Priority Data

Sep. 26, 2016 (KR) ..... 10-2016-0123234

(51) Int. Cl.
*G09G 3/3233* (2016.01)
*G09G 3/3258* (2016.01)
(Continued)

(52) U.S. Cl.
CPC ..... *G09G 3/3233* (2013.01); *G09G 3/3225* (2013.01); *G09G 3/3258* (2013.01);
(Continued)

(58) Field of Classification Search
CPC ..... G09G 2320/0295; G09G 2330/028; G09G 2300/0866; G09G 3/3208; H02M 3/33507;
(Continued)

(56) References Cited

U.S. PATENT DOCUMENTS 7,576,498 B2 8/2009 Kobayashi
8,749,458 B2 * 6/2014 Kim ..... G09G 3/3258 345/78
(Continued)

FOREIGN PATENT DOCUMENTS

KR 1020070085521 8/2007
KR 1020100040596 4/2010
(Continued)

OTHER PUBLICATIONS

European Search Report issued in corresponding application No. 17193303.9 dated May 22, 2018.

*Primary Examiner* — Sanjiv D. Patel
(74) *Attorney, Agent, or Firm* — F. Chau & Associates, LLC

(57) ABSTRACT

A light emitting display device including: a display panel; a plurality of pixels included in the display panel, each of the plurality of pixels including a driving switching element connected to a first power line and a light emitting element connected to a second power line; a maximum voltage detection unit for detecting a voltage from each of the light emitting elements of each of the pixels and outputting a maximum voltage that has a highest voltage level among the detected voltages; and a power supply unit for correcting a first driving voltage based on the maximum voltage and applying the corrected first driving voltage to the first power line.

23 Claims, 21 Drawing Sheets

(51) Int. Cl.
*G09G 3/3266* (2016.01)
*G09G 3/3225* (2016.01)

(52) U.S. Cl.
CPC ... *G09G 3/3266* (2013.01); *G09G 2300/0866* (2013.01); *G09G 2310/08* (2013.01); *G09G 2320/0285* (2013.01); *G09G 2320/0295* (2013.01); *G09G 2330/021* (2013.01); *G09G 2330/028* (2013.01)

(58) Field of Classification Search
CPC . H02M 7/53871; H03K 5/1532; H03K 17/74; H03F 2200/435; H03F 1/0211
See application file for complete search history.

(56) References Cited

U.S. PATENT DOCUMENTS 8,766,966 B2 7/2014 Kawashima
9,013,465 B2 4/2015 Chung
2004/0061672 A1* 4/2004 Page ..... G09G 3/3216 345/82
2006/0202913 A1* 9/2006 Hayafuji ..... G09G 3/3233 345/44
2010/0164385 A1* 7/2010 Ashikaga ..... H05B 41/2858 315/121
2012/0169704 A1* 7/2012 Chung ..... G09G 3/3233 345/212
2013/0154506 A1 6/2013 Ebisuno et al.
2015/0097872 A1* 4/2015 Jeong ..... G09G 3/3225 345/690
2016/0035265 A1* 2/2016 Park ..... G09G 3/2003 345/694
2017/0025061 A1* 1/2017 Takizawa ..... G09G 3/3233
2018/0033372 A1* 2/2018 Kishi ..... G09G 3/20
2018/0239379 A1* 8/2018 Zhang ..... G05F 1/10

FOREIGN PATENT DOCUMENTS

KR 1020110012274 2/2011
KR 1020120079364 7/2012
KR 1020140076098 6/2014
KR 1020150035073 4/2015

* cited by examiner

LIGHT EMITTING DISPLAY DEVICE

CROSS-REFERENCE TO RELATED APPLICATION

This application claims priority under 35 U.S.C. § 119 to Korean Patent Application No. 10-2016-0123234, filed on Sep. 26, 2016, the disclosure of which is incorporated by reference herein in its entirety.

TECHNICAL FIELD

Exemplary embodiments of the present invention relate to a light emitting display device, and more particularly, to a light emitting display device capable of reducing power consumption.

DESCRIPTION OF THE RELATED ART

Flat panel display devices are lighter and thinner than a traditional cathode ray tube (CRT) television set. Example flat panel devices include a liquid crystal display (LCD) device, a field emission display (FED) device, a plasma display panel (PDP) device, and an organic light emitting diode (OLED) display device.

OLED display devices display an image using an OLED that generates light by recombination of electrons and holes.

SUMMARY

According to an exemplary embodiment of the present invention, a light emitting display device includes: a display panel; a plurality of pixels included in the display panel, each of the plurality of pixels including a driving switching element connected to a first power line and a light emitting element connected to a second power line; a maximum voltage detection unit for detecting a voltage from each of the light emitting elements of each of the pixels and outputting a maximum voltage that has a highest voltage level among the detected voltages; and a power supply unit for correcting a first driving voltage based on the maximum voltage and applying the corrected first driving voltage to the first power line.

The maximum voltage detection unit may include a plurality of diode-type elements, a first terminal of each of the plurality of diode-type elements may be connected to a corresponding one of the light emitting elements, and a second terminal of each of the plurality of diode-type elements may be connected to a feedback input terminal of the power supply unit, and the feedback input terminal may be connected to the second power line.

The maximum voltage detection unit may further include a resistor connected between the feedback input terminal and the second power line.

The power supply unit may decrease the first driving voltage as the maximum voltage decreases.

At least one of the diode-type elements may be a diode or a diode-type transistor.

The power supply unit may correct the first driving voltage so that a difference voltage between the first driving voltage and a second driving voltage of the second power line may be substantially equal to a sum of the maximum voltage and a minimum drain-source voltage of a driving switching element connected to the light emitting element having the maximum voltage.

According to an exemplary embodiment of the present invention, a light emitting display device includes: a plurality of first pixels in a first display area of a display panel, each of the plurality of first pixels including a first driving switching element connected to a first power line and a first light emitting element connected to a second power line; a first maximum voltage detection unit for detecting a voltage from each of the first light emitting elements of each of the first pixels and outputting a first maximum voltage that has a highest voltage level among the detected voltages; a first power supply unit for correcting a first driving voltage based on the first maximum voltage and applying the corrected first driving voltage to the first power line; a plurality of second pixels in a second display area of the display panel, each of the plurality of second pixels including a second driving switching element connected to a third power line and a second light emitting element connected to the second power line; a second maximum voltage detection unit for detecting a voltage from each of the second light emitting elements of each of the second pixels and outputting a second maximum voltage that has a highest voltage level among the detected voltages; and a second power supply unit for correcting a third driving voltage based on the second maximum voltage and applying the corrected third driving voltage to the third power line.

The first maximum voltage detection unit may include: a first resistor connected between a first feedback input terminal of the first power supply unit and the second power line; and a first diode-type element connected between each one of the first light emitting elements of the first pixels and the first resistor, and a first terminal of each of the first diode-type elements may be connected to a corresponding one of the first light emitting elements of the first pixels, and a second terminal of each of the first diode-type elements may be connected to the first feedback input terminal.

The second maximum voltage detection unit may include: a second resistor connected between a second feedback input terminal of the second power supply unit and the second power line; and a second diode-type element connected between each one of the second light emitting elements of the second pixels and the second resistor, and a first terminal of each of the second diode-type elements may be connected to a corresponding one of the second light emitting elements of the second pixels, and a second terminal of each of the second diode-type elements may be connected to the second feedback input terminal.

The first power supply unit may correct the first driving voltage so that a difference voltage between the first driving voltage and a second driving voltage of the second power line may be substantially equal to a sum of the first maximum voltage and a minimum drain-source voltage of a first driving switching element connected to the first light emitting element having the first maximum voltage, and the second power supply unit may correct the third driving voltage so that a difference voltage between the second driving voltage and the third driving voltage may be substantially equal to a sum of the second maximum voltage and a minimum drain-source voltage of a second driving switching element connected to the second light emitting element having the second maximum voltage.

The first light emitting elements may include at least one of a red light emitting element, a green light emitting element, a blue light emitting element, and a white light emitting element.

The second light emitting elements may include at least one of a red light emitting element, a green light emitting element, a blue light emitting element, and a white light emitting element.

According to an exemplary embodiment of the present invention, a light emitting display device includes: a display panel; a plurality of first pixels disposed in the display panel, each of the plurality of first pixels including a first driving switching element connected to a first power line and a first light emitting element connected to a second power line; a first maximum voltage detection unit for detecting a voltage from each of the first light emitting elements of each of the first pixels and outputting a first maximum voltage that has a highest voltage level among the detected voltages; a first power supply unit for correcting a first driving voltage based on the first maximum voltage and applying the corrected first driving voltage to the first power line; a plurality of second pixels disposed in the display panel, each of the plurality of second pixels including a second driving switching element connected to a third power line and a second light emitting element connected to the second power line; a second maximum voltage detection unit for detecting a voltage from each of the second light emitting elements of each of the second pixels and outputting a second maximum voltage that has a highest voltage level among the detected voltages; and a second power supply unit for correcting a third driving voltage based on the second maximum voltage and applying the corrected third driving voltage to the third power line. The first light emitting element emits a light having a color different from a color of a light emitted from the second light emitting element.

The first maximum voltage detection unit may include: a first resistor connected between a first feedback input terminal of the first power supply unit and the second power line; and a first diode-type element connected between each one of the first light emitting elements of the first pixels and the first resistor, and a first terminal of each of the first diode-type elements may be connected to a corresponding one of the first light emitting elements of the first pixels, and a second terminal of each of the first diode-type elements may be connected to the first feedback input terminal.

The second maximum voltage detection unit may include: a second resistor connected between a second feedback input terminal of the second power supply unit and the second power line; and a second diode-type element connected between each one of the second light emitting elements of the second pixels and the second resistor, and a first terminal of each of the second diode-type elements may be connected to a corresponding one of the second light emitting elements of the second pixels, and a second terminal of each of the second diode-type elements may be connected to the second feedback input terminal.

The first power supply unit may correct the first driving voltage so that a difference voltage between the first driving voltage and a second driving voltage of the second power line may be substantially equal to a sum of the first maximum voltage and a minimum drain-source voltage of a first driving switching element connected to the first light emitting element having the first maximum voltage, and the second power supply unit may correct the third driving voltage so that a difference voltage between the second driving voltage and the third driving voltage may be substantially equal to a sum of the second maximum voltage and a minimum drain-source voltage of a second driving switching element connected to the second light emitting element having the second maximum voltage.

The first light emitting elements may include at least two of a red light emitting element, a green light emitting element, a blue light emitting element, and a white light emitting element.

The second light emitting elements may include at least two of a red light emitting element, a green light emitting element, a blue light emitting element, and a white light emitting element.

According to an exemplary embodiment of the present invention, a light emitting display device includes: a display panel including a plurality of pixels, each of the plurality of pixels including a driving switching element connected to a first power line and a light emitting element connected to a second power line; a maximum voltage detection unit for detecting a voltage from each of the light emitting elements of each of the pixels and outputting a maximum voltage that has a highest voltage level among the detected voltages; a timing controller for outputting a highest gray level image data signal having a highest gray level among image data signals applied to the plurality of pixels; a compensation voltage selection unit for storing compensation voltages corresponding to respective gray levels of a plurality of image data signals and selecting a compensation voltage corresponding to the highest gray level image data signal; a compensation voltage update unit for correcting the compensation voltage of the compensation voltage selection unit corresponding to the highest gray level image data signal based on the maximum voltage; and a power supply unit for correcting a first driving voltage based on the compensation voltage selected by the compensation voltage selection unit and applying the corrected first driving voltage to the first power line.

The compensation voltage update unit may further correct at least one other compensation voltage stored in the compensation voltage selection unit based on a variation amount of the compensation voltage corrected according to the maximum voltage.

When the number of image data signals having a lower gray level than a reference gray level among the image data signals applied to the plurality of pixels exceeds a threshold value, the timing controller may further generate a holding signal and apply the holding signal to the compensation voltage update unit.

In response to the holding signal, the compensation voltage update unit may maintain the compensation voltages of the compensation voltage selection unit to keep values they had before the generation of the highest gray level image data signal, regardless of an input of the highest gray level image data signal.

The compensation voltage update unit may correct the compensation voltage once every y-th horizontal period (y being a natural number greater than 2).

The maximum voltage detection unit may include: a resistor connected between a feedback input terminal of the compensation voltage update unit and the second power line; and a diode-type element connected between each one of the light emitting elements and the resistor, and a first terminal of each of the diode-type elements may be connected to a corresponding one of the light emitting elements, and a second terminal of each of the diode-type elements may be connected to the feedback input terminal.

The power supply unit may correct the first driving voltage so that a difference voltage between the first driving voltage and a second driving voltage of the second power line may be substantially equal to a sum of the selected compensation voltage and a minimum drain-source voltage of a driving switching element connected to the light emitting element having the maximum voltage.

The compensation voltage selection unit may be a look-up table.

According to an exemplary embodiment of the present invention, a light emitting display device includes: a display panel including a plurality of pixels, each of the plurality of pixels including a driving switching element connected to a first power line and a light emitting element connected to a second power line; a power supply unit for applying a power to the first power line; and a diode connected between an anode electrode of the light emitting element disposed in at least one pixel and a feedback input terminal of the power supply unit.

BRIEF DESCRIPTION OF THE DRAWINGS

The above and other features the present invention will be more clearly understood by describing in detail exemplary embodiments thereof with reference to the accompanying drawings, in which.

DETAILED DESCRIPTION OF THE EMBODIMENTS

Figure 1:
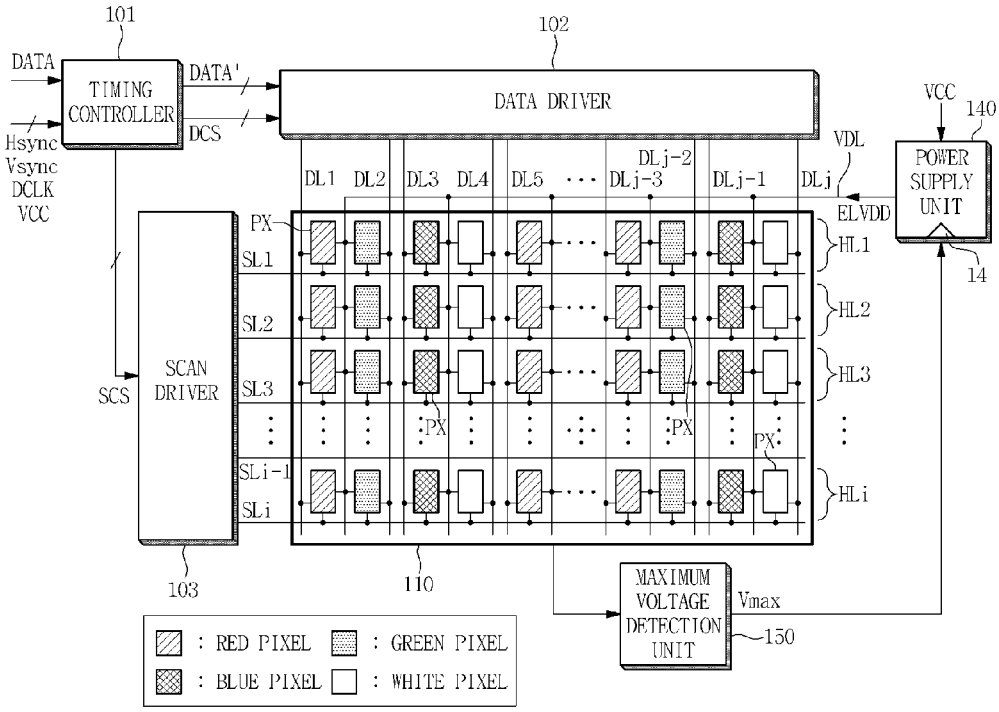
FIG. 1 is a block diagram illustrating a light emitting display device according to an exemplary embodiment of the present invention.

Hereinafter, exemplary embodiment of the present invention will be described more fully with reference to the accompanying drawings. The present invention may, however, be embodied in many different forms and should not be construed as being limited to the exemplary embodiments set forth herein. Like reference numerals may refer to like elements throughout the specification.

In the drawings, thicknesses of a plurality of layers and areas may be illustrated in an enlarged manner for clarity and ease of description thereof. When a layer, area, or plate is referred to as being "on" another layer, area, or plate, it may be directly on the other layer, area, or plate, or intervening layers, areas, or plates may be present therebetween.

Throughout the specification, when an element is referred to as being "connected" to another element, the element is "directly connected" to the other element, or "electrically connected" to the other element with one or more intervening elements interposed therebetween.

Hereinafter, a light emitting display device according to exemplary embodiments of the present invention will be described with reference to FIGS. 1 to 20.

Figure 2:
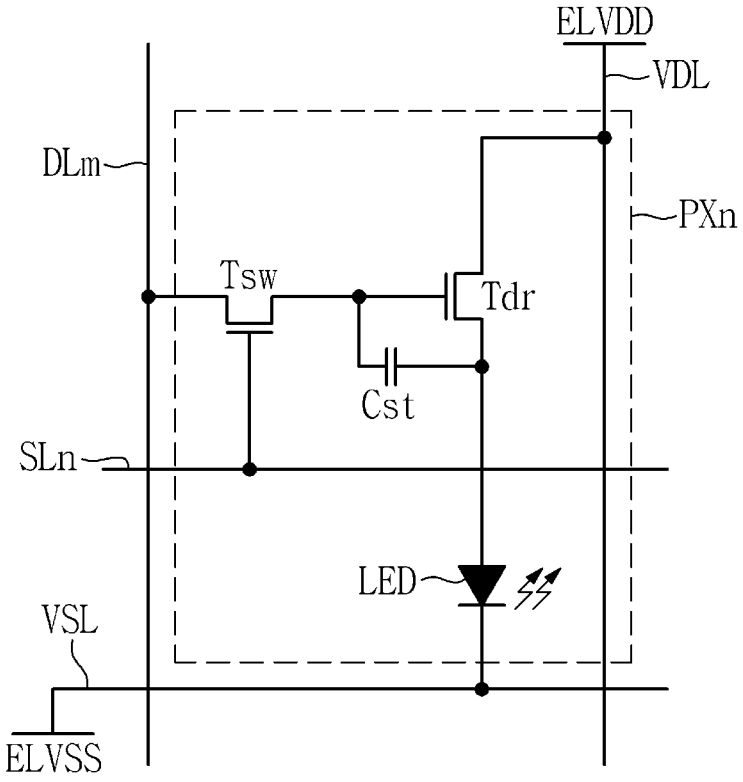
FIG. 2 is a detailed view illustrating one of pixels illustrated in FIG. 1 according to an exemplary embodiment of the present invention.

FIG. 1 is a block diagram illustrating a light emitting display device according to an exemplary embodiment of the present invention, and FIG. 2 is a detailed view illustrating one of pixels illustrated in FIG. 1 according to an exemplary embodiment of the present invention.

As illustrated in FIG. 1, the display device includes a display panel 110, a timing controller 101, a scan driver 103, a data driver 102, a power supply unit 140, and a maximum voltage detection unit 150.

The display panel 110 includes i number of scan lines SL1 to SLi, j number of data lines DL1 to DLj, i*j number of pixels PX, a high electric potential power line VDL and a low electric potential power line VSL. For the low electric potential power line VSL, refer to FIG. 2. In an exemplary embodiment of the present invention, each of i and j is a natural number greater than 1.

First to i-th scan signals are applied to the first to i-th scan lines SL1 to SLi, and first to j-th data voltages are applied to the first to j-th data lines DL1 to DLj.

The pixels PX are arranged on the display panel 110 in a matrix. The pixels PX may include red pixels for emitting red light, green pixels for emitting green light, blue pixels for emitting blue light, and white pixels for emitting white light.

A pixel connected to a (4p+1)-th data line may be a red pixel, a pixel connected to a (4p+2)-th data line may be a green pixel, a pixel connected to a (4p+3)-th data line may be a blue pixel, and a pixel connected to a (4p+4)-th data line may be a white pixel. In an exemplary embodiment of the present invention, p is 0 or a natural number. For example, as illustrated in FIG. 1, a pixel PX connected to the first data line DL1 may be a red pixel, a pixel PX connected to the second data line DL2 may be a green pixel, a pixel PX connected to the third data line DL3 may be a blue pixel, and a pixel PX connected to the fourth data line DL4 may be a white pixel.

A red pixel, a green pixel, a blue pixel and a white pixel adjacent to each other in a horizontal direction may be a unit pixel for displaying one unit image.

In an exemplary embodiment of the present invention, j number of pixels (hereinafter, n-th horizontal line pixels) arranged along an n-th horizontal line are individually connected to the first to j-th data lines DL1 to DLj, respectively. In addition, the n-th horizontal line pixels are connected in common to the n-th scan line, wherein n (of the n-th scan line) is one selected from 1 to i.

The n-th horizontal line pixels receive an n-th scan signal in common. In other words, all of j number of pixels located in the same horizontal line receive the same scan signal, but pixels located in different horizontal lines receive different scan signals. For example, red pixels, green pixels, blue pixels and white pixels located in the first horizontal line HL1 all receive a first scan signal, while red pixels, green pixels, blue pixels and white pixels located in the second horizontal line HL2 all receive a second scan signal that is output later in time than the first scan signal.

Two adjacent ones of the n-th horizontal line pixels are located between a (2q−1)-th data line and a 2q-th data line, wherein q is a natural number. In other words, two adjacent pixels of a horizontal line are located between a pair of data lines. For example, as illustrated in FIG. 1, a red pixel which is most adjacent to the scan driver 103 among the first horizontal line pixels and a green pixel adjacent to the red pixel are located between the first data line DL1 and the second data line DL2.

In the display panel 110, the high electric potential power line VDL is located between the (2q−1)-th data line and the 2q-th data line. In an exemplary embodiment of the present invention, one of two adjacent pixels between the (2q−1)-th data line and the 2q-th data line among the n-th horizontal line pixels is between the (2q−1)-th data line and the high electric potential power line VDL and the other of the two adjacent pixels is between the high electric potential power line VDL and the 2q-th data line. For example, as illustrated in FIG. 1, the red pixel which is most adjacent to the scan driver 103 among the first horizontal line pixels is between the first data line DL1 and the high electric potential power line VDL, and the green pixel adjacent to the red pixel is between the high electric potential power line VDL and the second data line DL2.

As will be described in detail later, the two adjacent pixels between the (2q−1)-th data line and the 2q-th data line among the n-th horizontal line pixels may have a symmetrical shape with respect to the high electric potential power line VDL passing between the two adjacent pixels.

Each pixel PX receives a high electric potential driving voltage ELVDD and a low electric potential driving voltage ELVSS.

Hereinafter, configurations of one of the pixels illustrated in FIG. 1 will be described in detail with reference to FIG. 2.

As illustrated in FIG. 2, an n-th pixel PXn may include a driving switching element Tdr, a data switching element Tsw, a storage capacitor Cst and a light emitting element (e.g., a light emitting diode, hereinafter referred to as "light emitting element LED").

The data switching element Tsw includes a gate electrode connected to an n-th scan line SLn and is connected between an m-th data line DLm and a gate electrode of the driving switching element Tdr. A drain electrode of the data switching element Tsw is connected to the m-th data line DLm, and a source electrode of the data switching element Tsw is connected to the gate electrode of the driving switching element Tdr, wherein m is a natural number.

The driving switching element Tdr includes the gate electrode connected to the source electrode of the data switching element Tsw and is connected between the high electric potential power line VDL and an anode electrode of the light emitting element LED. A drain electrode of the driving switching element Tdr is connected to the high electric potential power line VDL, and a source electrode of the driving switching element Tdr is connected to the anode electrode of the light emitting element LED.

The driving switching element Tdr adjusts an amount (e.g., density) of a driving current flowing from the high electric potential power line VDL to the low electric potential power line VSL according to a level of a signal applied to the gate electrode of the driving switching element Tdr.

The storage capacitor Cst is connected between the gate electrode of the driving switching element Tdr and the anode electrode of the light emitting element LED. The storage capacitor Cst stores a signal applied to the gate electrode of the driving switching element Tdr for one frame period.

The light emitting element LED emits light in accordance with the driving current applied through the driving switching element Tdr. The light emitting element LED emits light of a different brightness depending on the level of the driving current. The anode electrode of the light emitting element LED is connected to the source electrode (or the drain electrode) of the driving switching element Tdr, and a cathode electrode of the light emitting element LED is connected to the low electric potential power line VSL. The light emitting element LED may be an organic light emitting diode (OLED).

A light emitting element LED of the red pixel is a red light emitting element LED that emits a red light, a light emitting element LED of the green pixel is a green light emitting element LED that emits a green light, a light emitting element LED of the blue pixel is a blue light emitting element LED that emits a blue light, and a light emitting element LED of a white pixel is a white light emitting element LED that emits a white light.

It is to be understood the pixels may have various structures other than the structure illustrated in FIG. 2 and described above. For example, a pixel may further include a light emission control switching element connected between the high electric potential power line VDL and the driving switching element Tdr, and may further include another light emission control switching element connected between the driving switching element Tdr and the anode electrode of the light emitting element LED. In an exemplary embodiment of the present invention, the high electric potential power line VDL is indirectly connected to the driving switching element Tdr through the light emission control switching element.

As illustrated in FIG. 1, the timing controller 101 receives a vertical synchronization signal Vsync, a horizontal synchronization signal Hsync, an image data signal DATA, a reference clock signal DCLK and the like, which are output from a graphic controller provided in a system.

An interface circuit is provided between the timing controller 101 and the system, and the aforementioned signals output from the system are input to the timing controller 101 through the interface circuit. The interface circuit may be embedded in the timing controller 101.

The interface circuit may include a low voltage differential signaling (LVDS) receiver. The interface circuit lowers voltage levels of the vertical synchronization signal Vsync, the horizontal synchronization signal Hsync, the image data signal DATA and the reference clock signal DCLK output from the system, while raising frequencies thereof.

Electromagnetic interference (EMI) may occur due to high frequency components of a signal input from the interface circuit to the timing controller 101. To prevent the EMI, an EMI filter may be further provided between the interface circuit and the timing controller 101.

The timing controller 101 generates a scan control signal SCS for controlling the scan driver 103 and a data control signal DCS for controlling the data driver 102, using the vertical synchronization signal Vsync, the horizontal synchronization signal Hsync, and the reference clock signal DCLK.

The scan control signal SCS includes a gate start pulse, a gate shift clock, a gate output enable signal and the like.

The data control signal DCS includes a source start pulse, a source shift clock, a source output enable signal and the like.

In addition, the timing controller 101 rearranges the image data signals DATA input through the system and applies the rearranged image data signals DATA' to the data driver 102.

In an exemplary embodiment of the present invention, the timing controller 101 is operated by a driving power VCC output from a power unit provided in the system. For example, the driving power VCC is used as a power voltage of a phase locked loop ("PLL") circuit embedded in the timing controller 101.

The PLL circuit compares a reference clock signal DCLK input to the timing controller 101 with a reference frequency generated from an oscillator. When there is a deviation between the reference clock signal DCLK and the reference frequency, the PPL circuit adjusts the frequency of the reference clock signal DCLK by the deviation to generate a sampling clock signal. This sampling clock signal is a signal for sampling the image data signals DATA'.

The power supply unit 140 increases or decreases a driving power VCC input through the system to generate various voltages required for the display panel 110. The power supply unit 140 may be a direct current (DC) to DC converter.

The power supply unit 140 may include, for example, an output switching element for switching an output voltage of an output terminal thereof. The power supply unit 140 may include, for example, a pulse width modulator PWM for adjusting a duty ratio or a frequency of a control signal applied to a control terminal of the output switching element to increase or decrease the output voltage. Herein, the power supply unit 140 may include a pulse frequency modulator PFM, instead of the pulse width modulator PWM.

The pulse width modulator PWM may increase the duty ratio of the aforementioned control signal to raise the output voltage of the power supply unit 140 or decrease the duty ratio of the control signal to lower the output voltage of the power supply unit 140. The pulse frequency modulator PFM may increase the frequency of the aforementioned control signal to raise the output voltage of the power supply unit 140 or decrease the frequency of the control signal to lower the output voltage of the power supply unit 140.

The output voltage of the power supply unit 140 may include the high electric potential driving voltage ELVDD and the low electric potential driving voltage ELVSS (refer to FIG. 2 for ELVSS). In addition, the output voltage of the power supply unit 140 may further include a reference voltage, gamma reference voltages, a gate high voltage, and a gate low voltage.

The gamma reference voltages are voltages generated by voltage division of the reference voltage. The gamma reference voltages are analog voltages, which are applied to the data driver 102.

The high electric potential driving voltage ELVDD and the low electric potential driving voltage ELVSS output from the power supply unit 140 are applied to the display panel 110. For example, the high electric potential driving voltage ELVDD is applied to the pixels PX of the display panel 110 through the high electric potential power line VDL, and the low electric potential driving voltage ELVSS is applied to the pixels PX of the display panel 110 through the low electric potential power line VSL.

The gate high voltage is a high logic voltage of a gate signal set to be equal to or higher than a threshold voltage of the data switching element Tsw. The gate low voltage is a low logic voltage of the gate signal set to be an off voltage of the data switching element Tsw. The gate high voltage and the gate low voltage are applied to the scan driver 103.

The scan driver 103 generates scan signals according to the scan control signal SCS provided from the timing controller 101 and sequentially applies the scan signals to the plurality of scan lines SL1 to SLi.

The scan driver 103 may include, for example, a shift register that shifts the gate start pulse according to the gate shift clock to generate scan signals. The shift register may include a plurality of switching elements. The switching elements may be formed at a non-display area of the display panel 110. The switching elements may be formed through a substantially same process as a process through which the data switching element Tsw and the driving switching element Tdr at a display area of the display panel 110 are formed.

The data driver 102 receives the image data signals DATA' and the data control signal DCS from the timing controller 101. The data driver 102 samples the image data signals DATA' according to the data control signal DCS, sequentially latches the sampled image data signals corresponding to one horizontal line in each horizontal period, and simultaneously applies the latched image data signals to the data lines DL1 to DLj.

For example, the data driver 102 converts the image data signals DATA' applied from the timing controller 101 into analog image data signals using the gamma reference voltages input from the power supply unit 140 and applies the analog image data signals to the data lines DL1 to DLj.

The data driver 102 may include a gray level generator, which generates a plurality of gray level voltages using the gamma reference voltages applied from the power supply unit 140. The data driver 102 converts the image data signals DATA' applied from the timing controller 101 into analog signals using the gray level voltages.

In an exemplary embodiment of the present invention, the gray level generator may be located inside or outside the data driver 102.

The maximum voltage detection unit 150 detects a greatest voltage among respective voltages of the light emitting elements LED provided in the respective pixels PX. To accomplish this, the maximum voltage detection unit 150 detects a voltage from each of the light emitting elements LED in each pixel PX, selects a greatest voltage (hereinafter, "a maximum voltage Vmax") among the detected voltages, and applies the selected maximum voltage Vmax to the power supply unit 140. For example, the maximum voltage detection unit 150 detects i*j number of voltages from all pixels PX included in the display panel 110, and selects a greatest voltage among the i*j number of voltages to output the greatest voltage. For example, i*j number of voltages are selected because there are i*j number of pixels. In other words, as illustrated in FIG. 2, in a case where one light emitting element LED is provided for each pixel PX, the maximum voltage detection unit 150 detects i*j number of voltages from the i*j number of light emitting elements LEDs, and selects a greatest voltage that has a highest voltage level among the detected i*j number of voltages as the maximum voltage Vmax. The aforementioned voltage of the light emitting element LED refers to a voltage across opposite ends of the light emitting element LED. In other words, the voltage of the light emitting element LED refers to a voltage substantially equal to a difference between a voltage of the anode electrode of the light emitting element LED and the low electric potential driving voltage ELVSS.

The maximum voltage detection unit 150 may detect a voltage from the anode electrode of the light emitting element LED.

The maximum voltage detection unit 150 may be located outside the display panel 110. Alternatively, at least one of the components of the maximum voltage detection unit 150 may be located inside the display panel 110.

The maximum voltage Vmax output from the maximum voltage detection unit 150 is applied to the power supply unit 140. For example, the maximum voltage Vmax is input to a feedback input terminal 14 of the power supply unit 140.

The power supply unit 140 corrects the high electric potential driving voltage ELVDD based on the maximum voltage Vmax applied from the maximum voltage detection unit 150 and applies the corrected high electric potential driving voltage ELVDD to the high electric potential power line VDL.

Figure 3:
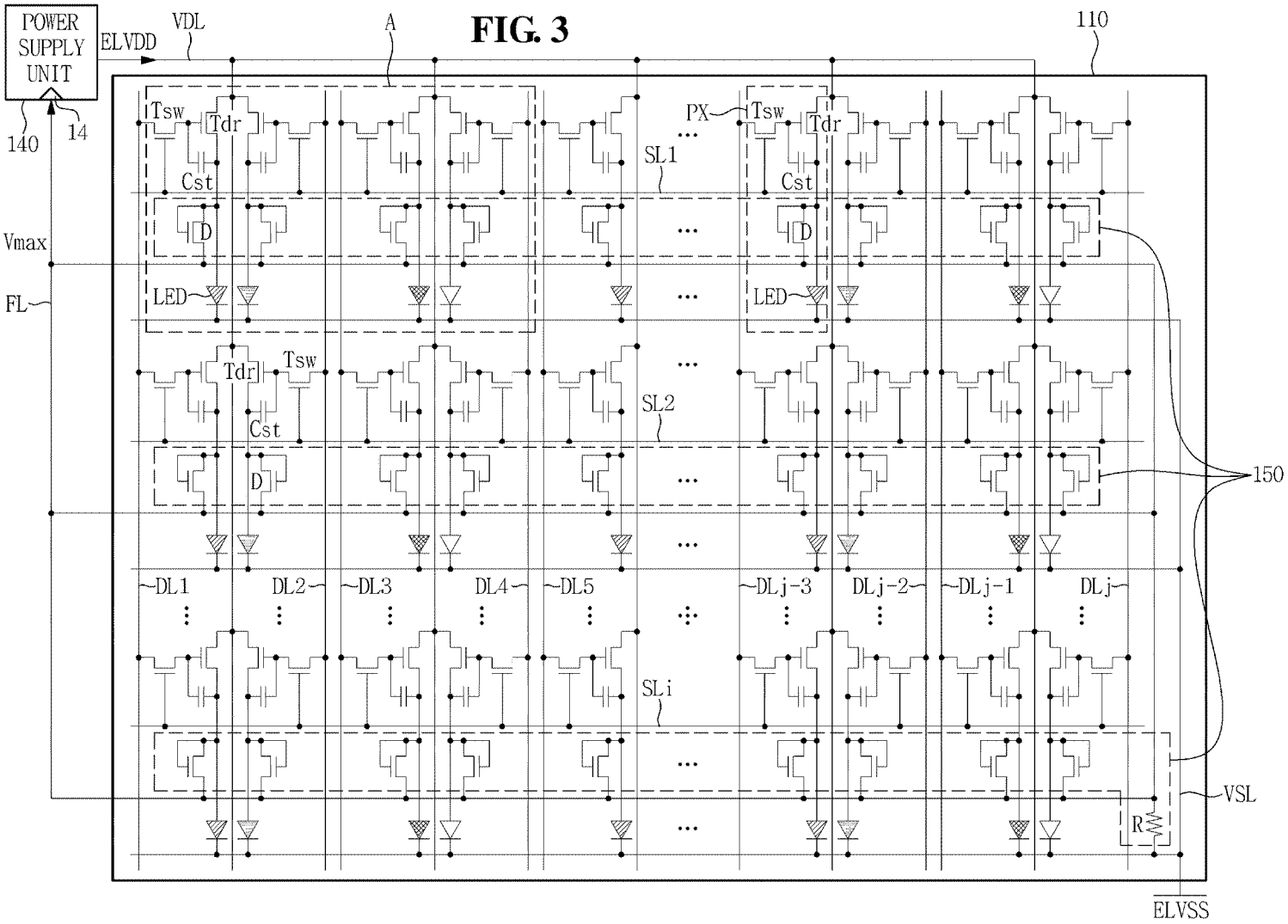
FIG. 3 is a detailed view illustrating a plurality of pixels and a maximum voltage detection unit of FIG. 1 according to an exemplary embodiment of the present invention.
Figure 4:
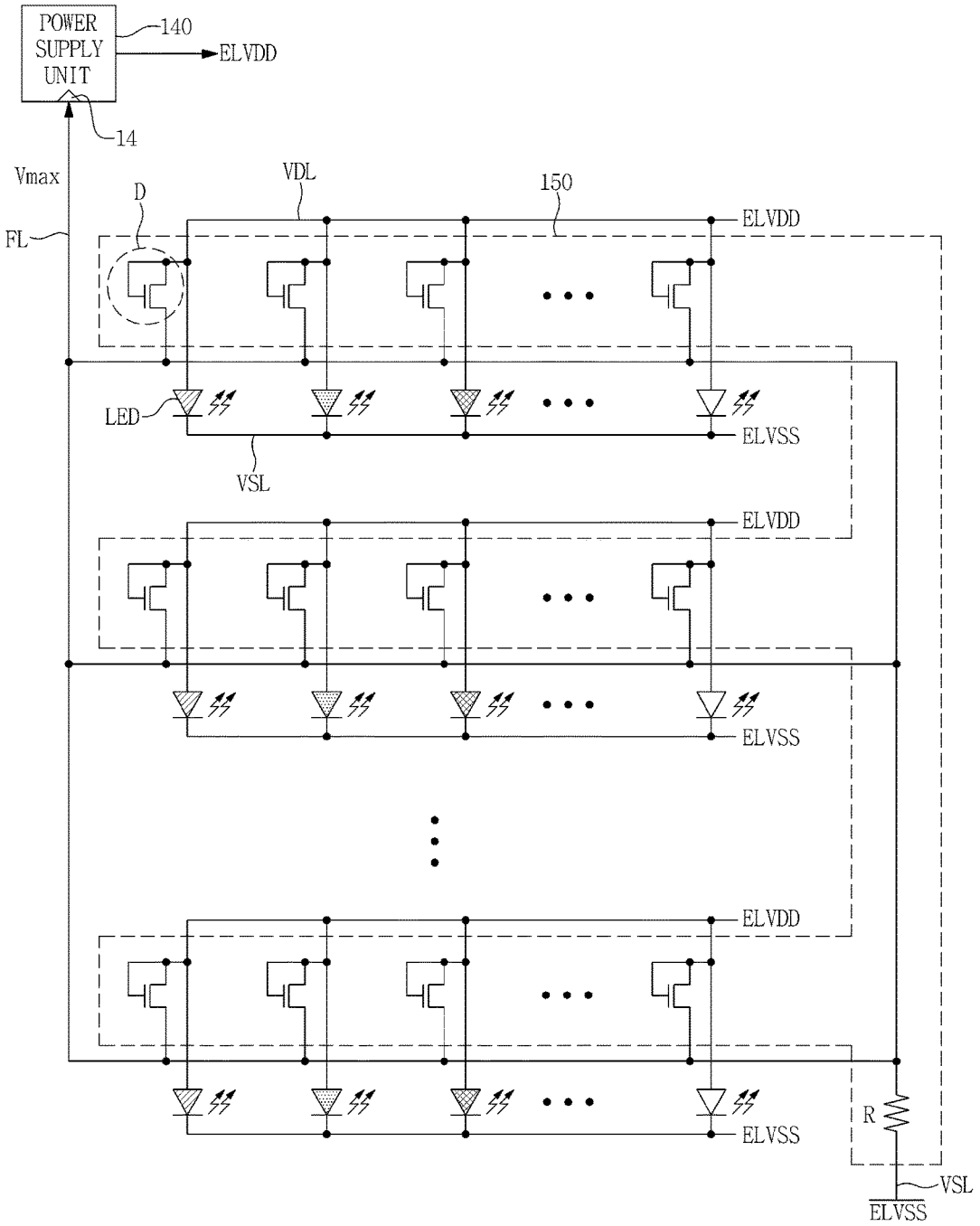
FIG. 4 is an explanatory view illustrating the relationship between the maximum voltage detection unit and a light emitting element of each pixel of FIG. 3 according to an exemplary embodiment of the present invention.
Figure 5:
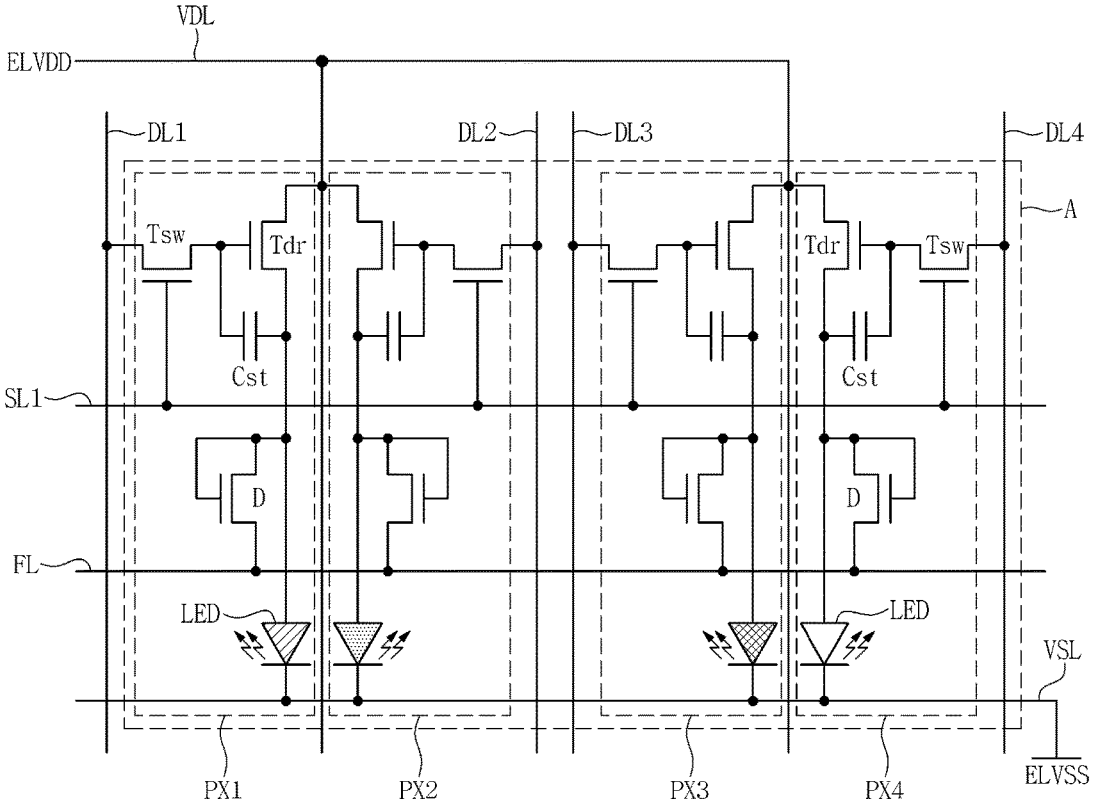
FIG. 5 is an enlarged view illustrating portion A of FIG. 3 according to an exemplary embodiment of the present invention.

FIG. 3 is a detailed view illustrating the plurality of pixels and the maximum voltage detection unit 150 of FIG. 1 according to an exemplary embodiment of the present invention, FIG. 4 is an explanatory view illustrating the relationship between the maximum voltage detection unit 150 and the light emitting element LED of each pixel of FIG. 3 according to an exemplary embodiment of the present invention, and FIG. 5 is an enlarged view illustrating portion A of FIG. 3 according to an exemplary embodiment of the present invention.

As illustrated in FIGS. 3 and 4, the maximum voltage detection unit 150 includes a plurality of diode-type elements D and at least one resistor R.

The plurality of diode-type elements D and the resistor R may be located on the display panel 110, as illustrated in FIG. 3. For example, the diode-type element D may be located on the display panel 110, one for each pixel PX. As a more specific example, as illustrated in FIG. 5, one diode-type element D is located in each of the first, second, third and fourth pixels PX1, PX2, PX3 and PX4.

The diode-type element D may be a diode or a diode-type transistor. For example, as illustrated in FIG. 5, the diode-type element D may be a diode-type transistor including a gate electrode connected to the anode electrode of the light emitting element LED and connected between the anode electrode and a feedback line FL. The gate electrode and a drain electrode of the diode-type element D are connected in common to the anode electrode. In an exemplary embodiment of the present invention, a contact point between the gate electrode and the drain electrode of the diode-type element D is an anode electrode of the diode-type element D, and a source electrode of the diode-type element D is a cathode electrode of the diode-type element D.

The respective anode electrodes of the diode-type elements D are individually connected to the light emitting elements LED, respectively. For example, as illustrated in FIG. 4, the respective anode electrodes of the diode-type elements D are individually connected to the anode electrodes of the light emitting elements LED, respectively.

The respective cathode electrodes of the diode-type elements D are connected in common to the feedback line FL, as illustrated in FIG. 4. The respective cathode electrodes of the diode-type elements D are connected in common to the feedback input terminal 14 of the power supply unit 140 through the feedback line FL.

The resistor R is connected between the feedback line FL and the low electric potential power line VSL, as illustrated in FIGS. 3 and 4. The resistor R is connected to the feedback input terminal 14 of the power supply unit 140 through the feedback line FL. In addition, one terminal of the resistor R is connected to the respective cathode electrodes of the diode-type elements D through the feedback line FL.

As described above, two adjacent ones of the n-th horizontal line pixels PX between the (2q−1)-th data line and the 2q-th data line may have a symmetrical shape with respect to the high electric potential power line VDL passing between the two adjacent pixels PX. For example, as illustrated in FIG. 5, a first pixel PX1 and a second pixel PX2 connected in common to a first scan line SL1 are between the first data line DL1 and the second data line DL2. Here, the first pixel PX1 and the second pixel PX2 may have a symmetrical shape with respect to the high electric potential power line VDL passing between the first pixel PX1 and the second pixel PX2. For example, with respect to the high electric potential power line VDL, the data switching element Tsw, the driving switching element Tdr, the storage capacitor Cst, the light emitting element LED and the diode-type element D of the first pixel PX1 may have symmetry with the data switching element Tsw, the driving switching element Tdr, the storage capacitor Cst, the light emitting element LED and the diode-type element D of the second pixel PX2, respectively.

Figure 6:
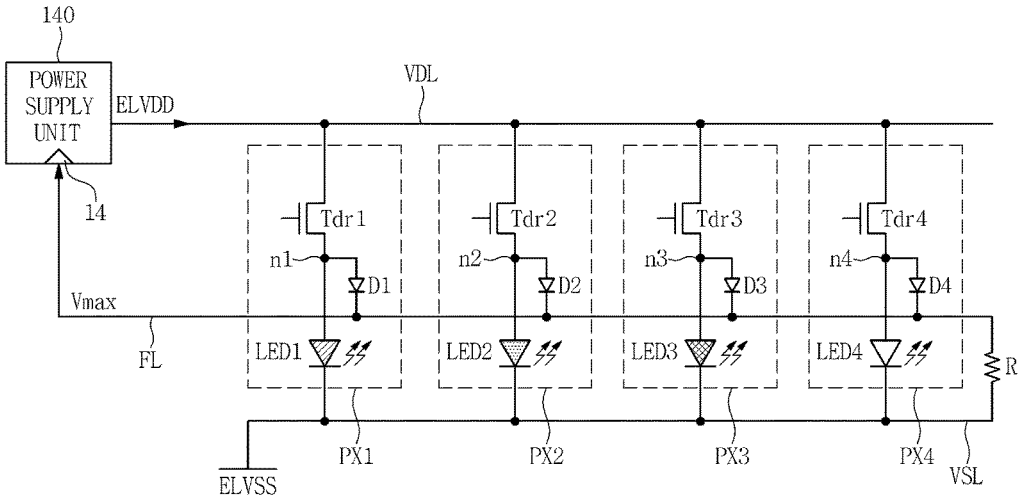
FIG. 6 is an explanatory view illustrating a method of detecting a maximum voltage from first, second, third and fourth pixels of FIG. 5 according to an exemplary embodiment of the present invention.

FIG. 6 is an explanatory view illustrating a method of detecting the maximum voltage Vmax from the first, second, third and fourth pixels PX1, PX2, PX3 and PX4 of FIG. 5 according to an exemplary embodiment of the present invention.

The aforementioned diode-type element D may be a diode, as illustrated in FIG. 6.

In the case where four pixels PX are provided in the display panel 110 as illustrated in FIG. 6, first, second, third and fourth diode-type elements D1, D2, D3 and D4 detect voltages of respective light emitting elements LED1, LED2, LED3 and LED4 provided in the four pixels PX1, PX2, PX3, and PX4, respectively, select a maximum voltage Vmax that has a highest voltage level among the detected voltages, and output the maximum voltage Vmax to the feedback line FL.

When data voltages of different gray levels are applied to the first, second, third and fourth pixels PX1, PX2, PX3 and PX4, voltages of the respective light emitting elements LED1, LED2, LED3 and LED4 provided in the four pixels PX1, PX2, PX3, and PX4 are different from each other. For example, when a greatest data voltage is applied to the fourth pixel PX4 among the first, second, third and fourth pixels PX1, PX2, PX3 and PX4, a voltage of the light emitting element LED4 in the fourth pixel PX4 has a highest voltage level. In other words, a voltage of a fourth node n4 among voltages of first, second, third and fourth nodes n1, n2, n3 and n4 is the greatest.

The first node n1 refers to an anode electrode of the first light emitting element LED1 provided in the first pixel PX1, the second node n2 refers to an anode electrode of the second light emitting element LED2 provided in the second pixel PX2, the third node n3 refers to an anode electrode of the third light emitting element LED3 provided in the third pixel PX3, and the fourth node n4 refers to an anode electrode of the fourth light emitting element LED4 provided in the fourth pixel PX4.

When the voltage of the fourth node n4 has a highest voltage level as described above, the voltage of the fourth node n4 is applied to the feedback line FL through the fourth diode-type element D4. Since the voltages of the first, second and third nodes n1, n2 and n3 are less than the voltage of the fourth node n4, the first, second and third diode-type elements D1, D2 and D3 are biased in the reverse direction by the voltage of the fourth node n4 applied to the feedback line FL. Accordingly, the voltage of the feedback line FL is substantially equal to the voltage of the fourth node n4. To be more exact, the voltage of the feedback line FL is a voltage obtained by subtracting a threshold voltage of the fourth diode-type element D4 from the voltage of the fourth node n4.

The maximum voltage Vmax applied to the feedback line FL, in other words, the voltage of the fourth node n4 is applied to the power supply unit 140 through the feedback input terminal 14.

The power supply unit 140 corrects the high electric potential driving voltage ELVDD based on the maximum voltage Vmax. For example, the power supply unit 140 decreases or increases a level of the high electric potential driving voltage ELVDD according to the level of the maximum voltage Vmax. For example, the power supply unit 140 decreases the high electric potential driving voltage ELVDD as the maximum voltage Vmax decreases. As a more specific example, the power supply unit 140 adjusts the level of the high electric potential driving voltage ELVDD so that the following Mathematical Formula 1 is satisfied.

$$ELVDD-ELVSS=Vmax+Vds.min \quad \text{<Mathematical Formula 1>}$$

In the above Mathematical Formula 1, Vds.min denotes a minimum drain-source voltage Vds.min of the driving switching element Tdr.

The minimum drain-source voltage Vds.min refers to a drain-source voltage that has a lowest voltage level among drain-source voltages of the driving switching element Tdr that may stably generate a driving current of a predetermined gray level. In other words, the minimum drain-source voltage Vds.min of the driving switching element Tdr is a drain-source voltage that has a lowest voltage level among drain-source voltages of the driving switching element Tdr that may generate a driving current of a predetermined gray level in a saturation region of the driving switching element Tdr.

A drain voltage of the driving switching element Tdr is a voltage of the drain electrode of the driving switching element Tdr, a source voltage of the driving switching element Tdr is a voltage of the source electrode of the driving switching element Tdr, and a drain-source voltage of the driving switching element Tdr is a difference voltage obtained by subtracting the voltage of the source electrode of the driving switching element Tdr from the voltage of the drain electrode of the driving switching element Tdr.

According to the above Mathematical Formula 1, the power supply unit 140 corrects the high electric potential driving voltage ELVDD so that a difference voltage between the high electric potential driving voltage ELVDD and the low electric potential driving voltage ELVSS becomes substantially equal to a sum of the maximum voltage Vmax and the minimum drain-source voltage Vds.min of the driving switching element Tdr. Accordingly, when the low electric potential driving voltage ELVSS and the minimum drain-source voltage Vds.min of the driving switching element Tdr are constant, the high electric potential driving voltage ELVDD decreases as the maximum voltage Vmax decreases.

Figure 7A:
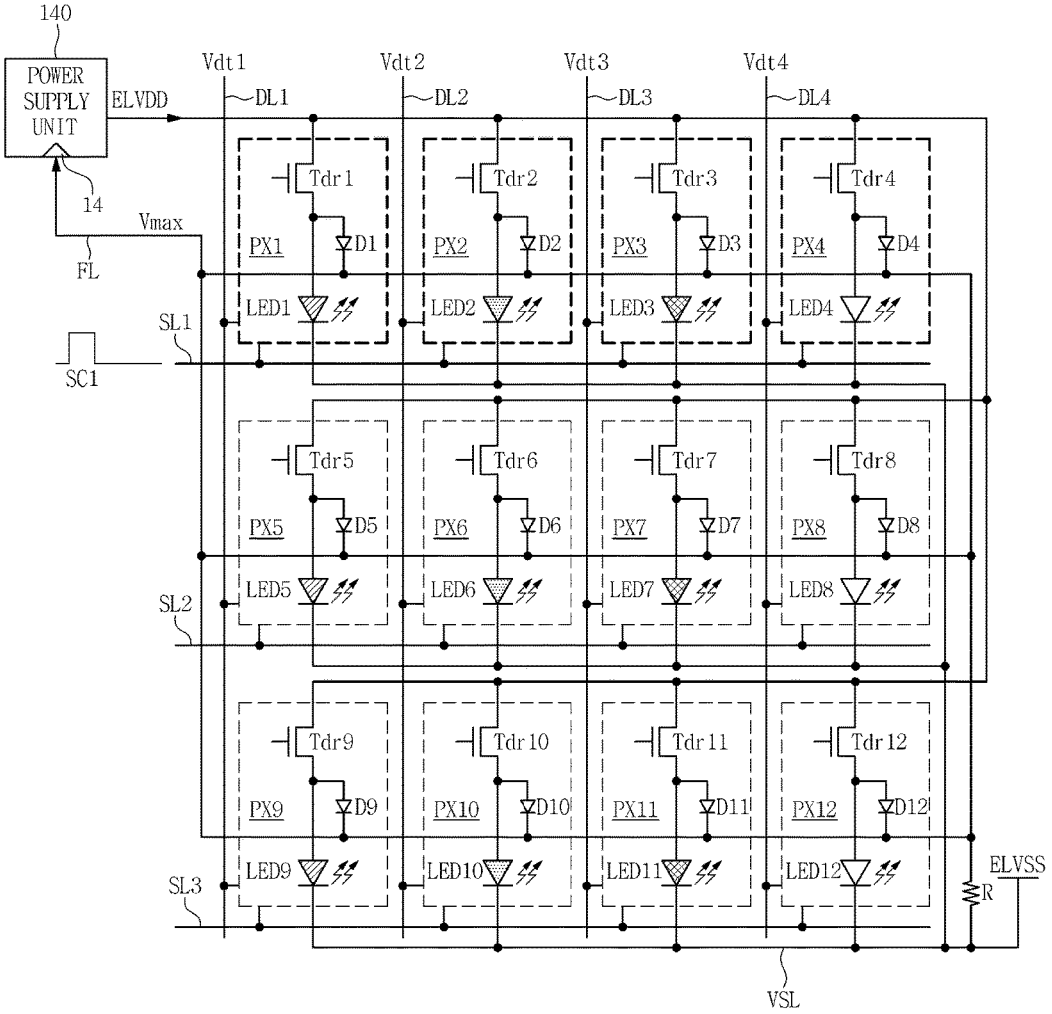
FIGS. 7A, 7B and 7C are explanatory views illustrating a method of driving a display device according to an exemplary embodiment of the present invention.
Figure 7B:
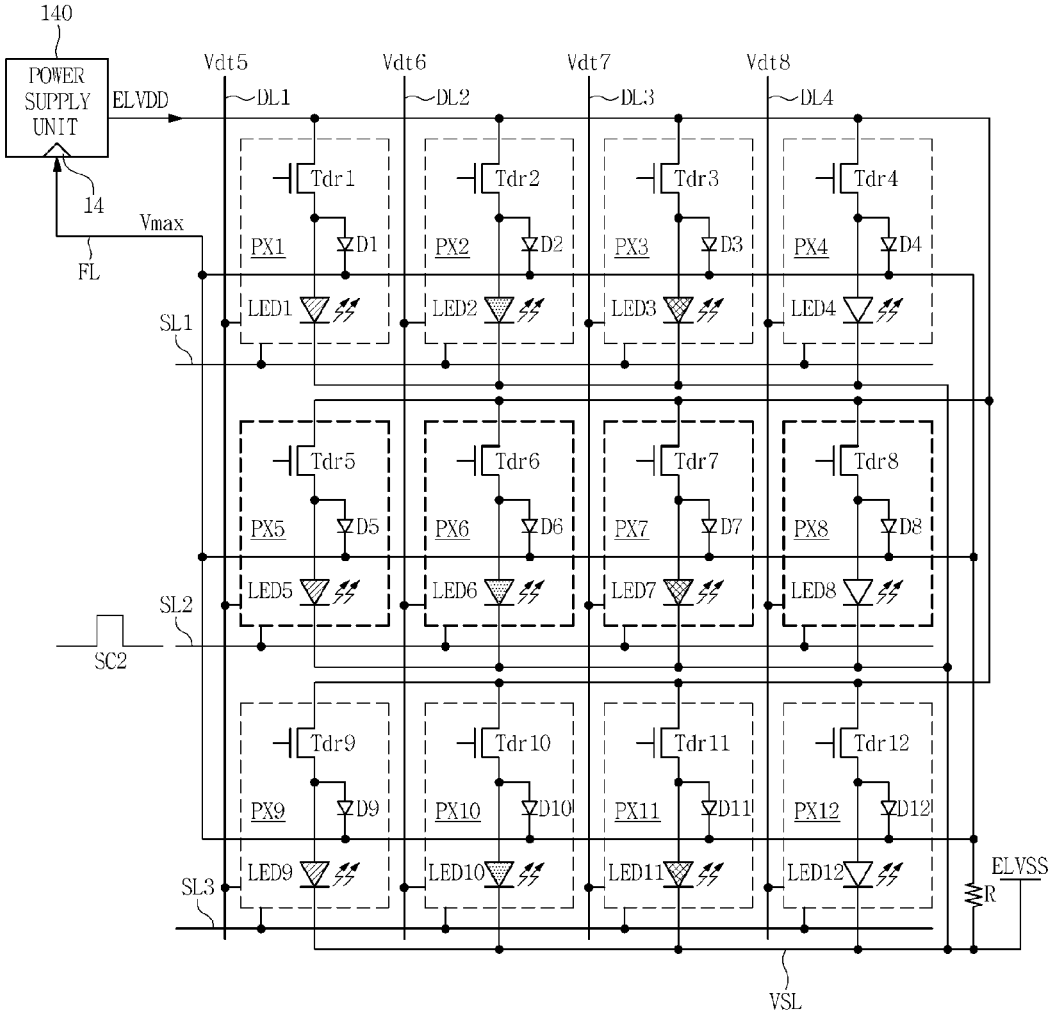
Figure 7C:
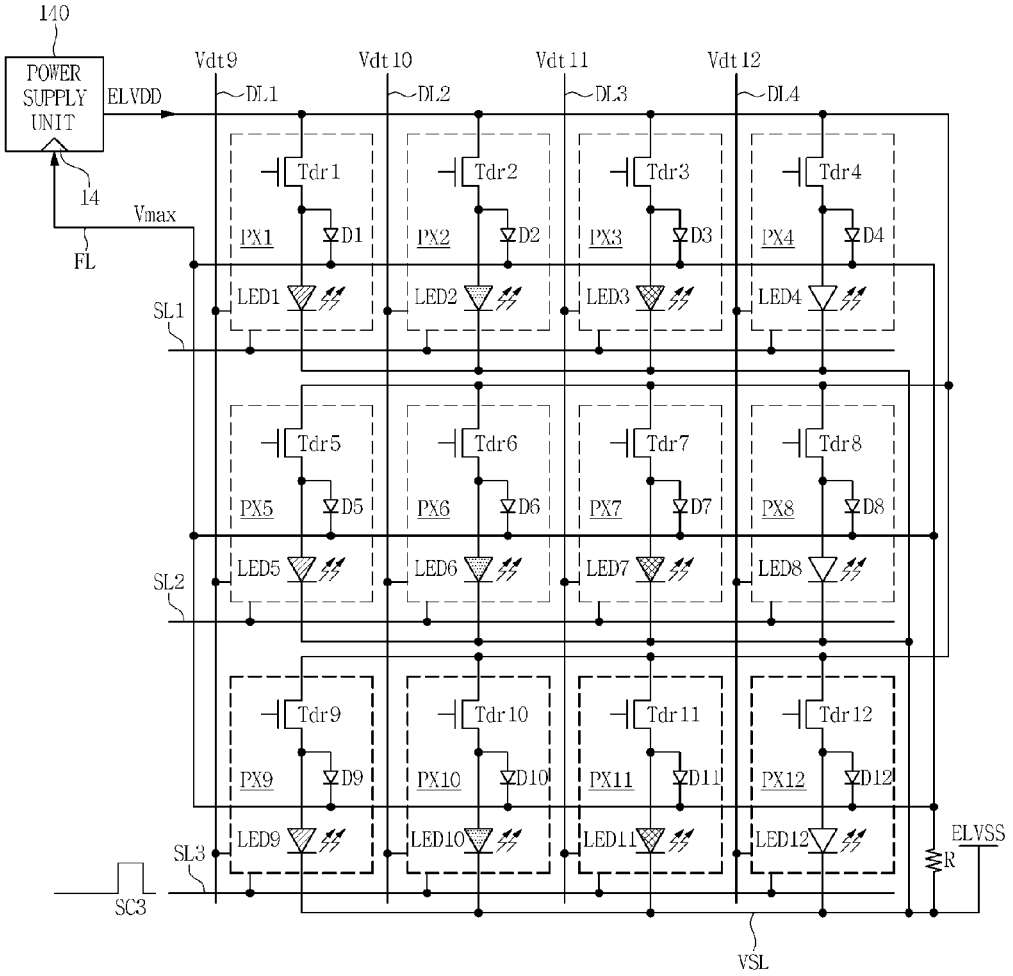

FIGS. 7A, 7B and 7C are explanatory views illustrating a method of driving a display device according to an exemplary embodiment of the present invention.

For ease of description, it is assumed that the display panel 110 of the display device includes a total of 12 pixels PX1 to PX12, as illustrated in FIGS. 7A, 7B and 7C. Further, for ease of description, a data switching element Tsw and a storage capacitor Cst of each of the pixels PX1 to PX12 are not illustrated.

First, as illustrated in FIG. 7A, a first scan signal SC1 is applied to the first scan line SL1 in a first horizontal period. Then, the first, second, third and fourth pixels PX1, PX2, PX3 and PX4 connected to the first scan line SL1 are activated. The first scan signal SC1 is applied to each of a gate electrode of a data switching element in the first pixel PX1, a gate electrode of a data switching element in the second pixel PX2, a gate electrode of a data switching element in the third pixel PX3, and a gate electrode of a data switching element in the fourth pixel PX4. Accordingly, the respective data switching elements of the first, second, third and fourth pixels PX1, PX2, PX3 and PX4 are turned on.

In an exemplary embodiment of the present invention, the activated first pixel PX1 receives a first data voltage Vdt1 through a first data line DL1 connected thereto, the activated second pixel PX2 receives a second data voltage Vdt2 through a second data line DL2 connected thereto, the activated third pixel PX3 receives a third data voltage Vdt3 through a third data line DL3 connected thereto, and the activated fourth pixel PX4 receives a fourth data voltage Vdt4 through a fourth data line DL4 connected thereto.

The first data voltage Vdt1 is applied to a drain electrode and a source electrode of the data switching element in the first pixel PX1, the second data voltage Vdt2 is applied to a drain electrode and a source electrode of the data switching element in the second pixel PX2, the third data voltage Vdt3 is applied to a drain electrode and a source electrode of the data switching element in the third pixel PX3, and the fourth data voltage Vdt4 is applied to a drain electrode and a source electrode of the data switching element in the fourth pixel PX4.

Then, the first data voltage Vdt1 is applied to a gate electrode of a first driving switching element Tdr1 through the turned-on data switching element of the first pixel PX1, the second data voltage Vdt2 is applied to a gate electrode of a second driving switching element Tdr2 through the turned-on data switching element of the second pixel PX2, the third data voltage Vdt3 is applied to a gate electrode of a third driving switching element Tdr3 through the turned-on data switching element of the third pixel PX3, and the fourth data voltage Vdt4 is applied to a gate electrode of a fourth driving switching element Tdr4 through the turned-on data switching element of the fourth pixel PX4. Accordingly, the first, second, third and fourth driving switching elements Tdr1, Tdr2, Tdr3 and Tdr4 are turned on.

A first light emitting element LED1 emits light by a driving current generated through the turned on first driving switching element Tdr1, a second light emitting element LED2 emits light by a driving current generated through the turned on second driving switching element Tdr2, a third light emitting element LED3 emits light by a driving current generated through the turned on third driving switching element Tdr3, and a fourth light emitting element LED4 emits light by a driving current generated through the turned on fourth driving switching element Tdr4.

In an exemplary embodiment of the present invention, a voltage of the first light emitting element LED1 is determined based on the first data voltage Vdt1 applied to the gate electrode of the first driving switching element Tdr1, a voltage of the second light emitting element LED2 is determined based on the second data voltage Vdt2 applied to the gate electrode of the second driving switching element Tdr2, a voltage of the third light emitting element LED3 is determined based on the third data voltage Vdt3 applied to the gate electrode of the third driving switching element Tdr3, and a voltage of the fourth light emitting element LED4 is determined based on the fourth data voltage Vdt4 applied to the gate electrode of the fourth driving switching element Tdr4. The respective voltages of the first, second, third and fourth light emitting elements LED1, LED2, LED3 and LED4 are maintained for one frame period.

During a first horizontal period, the voltage of the first light emitting element LED1 is detected through a first diode-type element D1, the voltage of the second light emitting element LED2 is detected through a second diode-type element D2, the voltage of the third light emitting element LED3 is detected through a third diode-type element D3, and the voltage of the fourth light emitting element LED4 is detected through a fourth diode-type element D4.

In an exemplary embodiment of the present invention, during the first horizontal period, voltages of the fifth, sixth, seventh, eighth, ninth, tenth, eleventh and twelfth light emitting elements LED5, LED6, LED7, LED8, LED9, LED10, LED11 and LED12 are detected in the fifth, sixth, seventh, eighth, ninth, tenth, eleventh and twelfth pixels PX5, PX6, PX7, PX8, PX9, PX10, PX11 and PX12 that are in an inactive state. The voltages of the fifth, sixth, seventh, eighth, ninth, tenth, eleventh and twelfth light emitting elements LED5, LED6, LED7, LED8, LED9, LED10, LED11 and LED12 are detected through fifth, sixth, seventh, eighth, ninth, tenth, eleventh and twelfth diode-type elements D5, D6, D7, D8, D9, D10, D11 and D12, respectively. In an exemplary embodiment of the present invention, during the first horizontal period, the fifth, sixth, seventh, eighth, ninth, tenth, eleventh and twelfth pixels PX5, PX6, PX7, PX8, PX9, PX10, PX11 and PX12 that are in the inactive state respectively maintain the data voltages applied in a previous frame period. Accordingly, the voltages of the fifth, sixth, seventh, eighth, ninth, tenth, eleventh and twelfth light emitting elements LED5, LED6, LED7, LED8, LED9, LED10, LED11 and LED12 detected in the first horizontal period are voltages determined based on data voltages of the previous frame period.

The aforementioned first horizontal period is a horizontal period included in a current frame period. Further, the data voltages maintained by the fifth, sixth, seventh, eighth, ninth, tenth, eleventh and twelfth pixels PX5, PX6, PX7, PX8, PX9, PX10, PX11 and PX12 in the first horizontal period may be data voltages applied in one horizontal period of the aforementioned previous frame period.

A maximum voltage Vmax among the voltages detected from the first, second, third, fourth, fifth, sixth, seventh, eighth, ninth, tenth, eleventh and twelfth light emitting elements LED1, LED2, LED3, LED4, LED5, LED6, LED7, LED8, LED9, LED10, LED11 and LED12 in the first horizontal period is applied to a power supply unit 140 through a feedback line FL.

The power supply unit 140 corrects a high electric potential driving voltage ELVDD based on the maximum voltage Vmax detected in the first horizontal period.

Subsequently, as illustrated in FIG. 7B, a second scan signal SC2 is applied to a second scan line SL2 in a second horizontal period. Then, the fifth, sixth, seventh and eighth pixels PX5, PX6, PX7 and PX8 connected to the second scan line SL2 are activated.

In an exemplary embodiment of the present invention, the activated fifth pixel PX5 receives a fifth data voltage Vdt5 through the first data line DL1 connected thereto, the activated sixth pixel PX6 receives a sixth data voltage Vdt6 through the second data line DL2 connected thereto, the activated seventh pixel PX7 receives a seventh data voltage Vdt7 through the third data line DL3 connected thereto, and the activated eighth pixel PX8 receives an eighth data voltage Vdt8 through the fourth data line DL4 connected thereto.

In an exemplary embodiment of the present invention, the fifth data voltage Vdt5 is applied to a gate electrode of a fifth driving switching element Tdr5, the sixth data voltage Vdt6 is applied to a gate electrode of a sixth driving switching element Tdr6, the seventh data voltage Vdt7 is applied to a gate electrode of a seventh driving switching element Tdr7, and the eighth data voltage Vdt8 is applied to a gate electrode of an eighth driving switching element Tdr8. Accordingly, the fifth, sixth, seventh and eighth driving switching elements Tdr5, Tdr6, Tdr7 and Tdr8 are turned on. Further, the fifth, sixth, seventh and eighth light emitting elements LED5, LED6, LED7 and LED8 emit light by the turned on fifth, sixth, seventh and eighth driving switching elements Tdr5, Tdr6, Tdr7 and Tdr8.

In an exemplary embodiment of the present invention, a voltage of the fifth light emitting element LED5 is determined based on the fifth data voltage Vdt5 applied to the gate electrode of the fifth driving switching element Tdr5, a voltage of the sixth light emitting element LED6 is determined based on the sixth data voltage Vdt6 applied to the gate electrode of the sixth driving switching element Tdr6, a voltage of the seventh light emitting element LED7 is determined based on the seventh data voltage Vdt7 applied to the gate electrode of the seventh driving switching element Tdr7, and a voltage of the eighth light emitting element LED8 is determined based on the eighth data voltage Vdt8 applied to the gate electrode of the eighth driving switching element Tdr8. The respective voltages of the fifth, sixth, seventh and eighth light emitting elements LED5, LED6, LED7 and LED8 are maintained for one frame period.

During the second horizontal period, the voltage of the fifth light emitting element LED5 is detected through the fifth diode-type element D5, the voltage of the sixth light emitting element LED6 is detected through the sixth diode-type element D6, the voltage of the seventh light emitting element LED7 is detected through the seventh diode-type element D7, and the voltage of the eighth light emitting element LED8 is detected through the eighth diode-type element D8.

In an exemplary embodiment of the present invention, during the second horizontal period, voltages of the first, second, third, fourth, ninth, tenth, eleventh and twelfth light emitting elements LED1, LED2, LED3, LED4, LED9, LED10, LED11 and LED12 are detected from the first, second, third, fourth, ninth, tenth, eleventh and twelfth pixels PX1, PX2, PX3, PX4, PX9, PX10, PX11 and PX12 that are in the inactive state. The voltages of the first, second, third, fourth, ninth, tenth, eleventh and twelfth light emitting elements LED1, LED2, LED3, LED4, LED9, LED10, LED11 and LED12 are respectively detected through the first, second, third, fourth, ninth, tenth, eleventh and twelfth diode-type elements D1, D2, D3, D4, D9, D10, D11 and D12. In an exemplary embodiment of the present invention, during the second horizontal period, the first, second, third and fourth pixels PX1, PX2, PX3 and PX4 in the inactive state respectively maintain the first, second, third and fourth data voltages Vdt1, Vdt2, Vdt3 and Vdt4 applied in the first horizontal period, and the ninth, tenth, eleventh and twelfth pixels PX9, PX10, PX11 and PX12 respectively maintain the data voltages applied in the previous frame period. Accordingly, voltages of the first, second, third and fourth light emitting elements LED1, LED2, LED3 and LED4 detected in the second horizontal period are voltages determined based on the first, second, third and fourth data voltages Vdt1, Vdt2, Vdt3 and Vdt4 applied in the first horizontal period. Further, voltages of the ninth, tenth, eleventh and twelfth light emitting elements LED9, LED10, LED11 and LED12 detected in the second horizontal period are voltages determined based on the data voltages of the previous frame period.

A maximum voltage Vmax among the voltages detected from the first, second, third, fourth, fifth, sixth, seventh, eighth, ninth, tenth, eleventh and twelfth light emitting elements LED1, LED2, LED3, LED4, LED5, LED6, LED7, LED8, LED9, LED10, LED11 and LED12 in the second horizontal period is applied to the power supply unit 140 through the feedback line FL. In an exemplary embodiment of the present invention, the maximum voltage Vmax detected in the second horizontal period may be different from the maximum voltage Vmax detected in the first horizontal period, depending on the voltages of the fifth, sixth, seventh and eighth light emitting elements LED5, LED6, LED7 and LED8.

The power supply unit 140 corrects the high electric potential driving voltage ELVDD based on the maximum voltage Vmax detected in the second horizontal period.

Next, as illustrated in FIG. 7C, a third scan signal SC3 is applied to a third scan line SL3 in a third horizontal period. Then, the ninth, tenth, eleventh and twelfth pixels PX9, PX10, PX11 and PX12 connected to the third scan line SL3 are activated.

In an exemplary embodiment of the present invention, the activated ninth pixel PX9 receives a ninth data voltage Vdt9 through the first data line DL1 connected thereto, the activated tenth pixel PX10 receives a tenth data voltage Vdt10 through the second data line DL2 connected thereto, the activated eleventh pixel PX11 receives an eleventh data voltage Vdt11 through the third data line DL3 connected thereto, and the activated twelfth pixel PX12 receives a twelfth data voltage Vdt12 through the fourth data line DL4 connected thereto.

In an exemplary embodiment of the present invention, the ninth data voltage Vdt9 is applied to a gate electrode of a ninth driving switching element Tdr9, the tenth data voltage Vdt10 is applied to a gate electrode of a tenth driving switching element Tdr10, the eleventh data voltage Vdt11 is applied to a gate electrode of an eleventh driving switching element Tdr11, and the twelfth data voltage Vdt12 is applied to a gate electrode of a twelfth driving switching element Tdr12. Accordingly, the ninth, tenth, eleventh and twelfth driving switching elements Tdr9, Tdr10, Tdr11 and Tdr12 are turned on. Further, the ninth, tenth, eleventh and twelfth light emitting elements LED9, LED10, LED11 and LED12 emit light by the turned on ninth, tenth, eleventh and twelfth driving switching elements Tdr9, Tdr10, Tdr11 and Tdr12.

In an exemplary embodiment of the present invention, a voltage of the ninth light emitting element LED9 is determined based on the ninth data voltage Vdt9 applied to the gate electrode of the ninth driving switching element Tdr9, a voltage of the tenth light emitting element LED10 is determined based on the tenth data voltage Vdt10 applied to the gate electrode of the tenth driving switching element Tdr10, a voltage of the eleventh light emitting element LED11 is determined based on the eleventh data voltage Vdt11 applied to the gate electrode of the eleventh driving switching element Tdr11, and a voltage of the twelfth light emitting element LED12 is determined based on the twelfth data voltage Vdt12 applied to the gate electrode of the twelfth driving switching element Tdr12. The respective voltages of the ninth, tenth, eleventh and twelfth light emitting elements LED9, LED10, LED11 and LED12 are maintained for one frame period.

During the third horizontal period, the voltage of the ninth light emitting element LED9 is detected through the ninth diode-type element D9, the voltage of the tenth light emitting element LED10 is detected through the tenth diode-type element D10, the voltage of the eleventh light emitting element LED11 is detected through the eleventh diode-type element D11, and the voltage of the twelfth light emitting element LED12 is detected through the twelfth diode-type element D12.

In an exemplary embodiment of the present invention, during the third horizontal period, voltages of the first, second, third, fourth, fifth, sixth, seventh and eighth light emitting elements LED1, LED2, LED3, LED4, LED5, LED6, LED7 and LED8 are detected from the first, second, third, fourth, fifth, sixth, seventh and eighth pixels PX1, PX2, PX3, PX4, PX5, PX6, PX7 and PX8 that are in the inactive state. The voltages of the first, second, third, fourth, fifth, sixth, seventh and eighth light emitting elements LED1, LED2, LED3, LED4, LED5, LED6, LED7 and LED8 are respectively detected through the first, second, third, fourth, fifth, sixth, seventh and eighth diode-type elements D1, D2, D3, D4, D5, D6, D7 and D8. In an exemplary embodiment of the present invention, during the third horizontal period, the first, second, third and fourth pixels PX1, PX2, PX3 and PX4 in the inactive state respectively maintain the first, second, third and fourth data voltages Vdt1, Vdt2, Vdt3 and Vdt4 applied in the first horizontal period, and the fifth, sixth, seventh and eighth pixels PX5, PX6, PX7 and PX8 respectively maintain the fifth, sixth, seventh and eighth data voltages Vdt5, Vdt6, Vdt7 and Vdt8 applied in the second horizontal period. Accordingly, voltages of the first, second, third and fourth light emitting elements LED1, LED2, LED3 and LED4 detected in the third horizontal period are voltages determined based on the first, second, third and fourth data voltages Vdt1, Vdt2, Vdt3 and Vdt4 applied in the first horizontal period. Further, voltages of the fifth, sixth, seventh and eighth light emitting elements LED5, LED6, LED7 and LED8 detected in the third horizontal period are voltages determined based on the fifth, sixth, seventh and eighth data voltages Vdt5, Vdt6, Vdt7 and Vdt8 applied in the second horizontal period.

A maximum voltage Vmax among the voltages detected from the first, second, third, fourth, fifth, sixth, seventh, eighth, ninth, tenth, eleventh and twelfth light emitting elements LED1, LED2, LED3, LED4, LED5, LED6, LED7, LED8, LED9, LED10, LED11 and LED12 in the third horizontal period is applied to the power supply unit 140 through the feedback line FL. In an exemplary embodiment of the present invention, the maximum voltage Vmax detected in the third horizontal period may be different from the maximum voltage Vmax detected in the second horizontal period, depending on the voltages of the ninth, tenth, eleventh and twelfth light emitting elements LED9, LED10, LED11 and LED12. In addition, the maximum voltage Vmax detected in the third horizontal period may be different from the maximum voltage Vmax detected in the second horizontal period.

The power supply unit 140 corrects the high electric potential driving voltage ELVDD based on the maximum voltage Vmax detected in the third horizontal period.

As such, the maximum voltage Vmax is detected from the light emitting elements (for example, light emitting elements LED1, LED2, LED3, LED4, LED5, LED6, LED7, LED8, LED9, LED10, LED11 and LED12) of all of the pixels (for example, pixels PX1, PX2, PX3, PX4, PX5, PX6, PX7, PX8, PX9, PX10, PX11 and PX12) of a display panel 110 in each horizontal period, and the level of the high electric potential driving voltage ELVDD is optimized in each horizontal period based on the maximum voltage Vmax. Accordingly, power consumption of the display device may be reduced.

In an exemplary embodiment of the present invention, each horizontal period includes a data enable period and a blank period. During the data enable period, data voltages of one horizontal line are input to the data lines. During the blank period in each horizontal period, the voltage (the maximum voltage Vmax) of the feedback line FL is discharged by the low electric potential driving voltage ELVSS. Accordingly, the voltage of the feedback line FL may be maintained at 0 V after the maximum voltage Vmax is detected and before a succeeding horizontal period starts.

Figure 8:
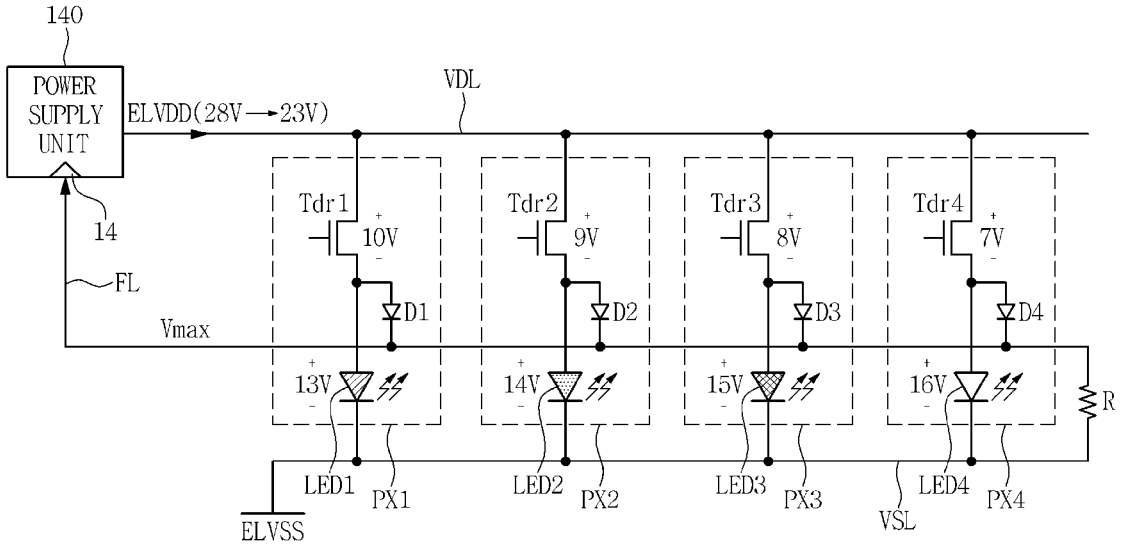
FIG. 8 is an explanatory view illustrating a method of correcting a high electric potential driving voltage based on a maximum voltage of a light emitting element detected from the first, second, third and fourth pixels according to an exemplary embodiment of the present invention, and power consumption reducing effects according to the method.

FIG. 8 is an explanatory view illustrating a method of correcting the high electric potential driving voltage ELVDD based on the maximum voltage Vmax of light emitting elements detected from first, second, third and fourth pixels PX1, PX2, PX3 and PX4 according to an exemplary embodiment of the present invention and power consumption reducing effects according to the method.

Herein, it is assumed that the display panel 110 includes four pixels PX in total as illustrated in FIG. 8.

In the case where, in a predetermined horizontal period, a voltage of a first light emitting element LED1 included in the first pixel PX1 is 13 V, a voltage of a second light emitting element LED2 included in the second pixel PX2 is 14 V, a voltage of a third light emitting element LED3 included in the third pixel PX3 is 15 V, and a voltage of a fourth light emitting element LED4 included in the fourth pixel PX4 is 16 V, a maximum voltage Vmax among the voltages of the first, second, third and fourth light emitting elements LED1, LED2, LED3 and LED4 is 16 V. The maximum voltage Vmax of 16 V is applied to the power supply unit 140 through the feedback line FL.

Then, the power supply unit 140 sets a high electric potential driving voltage ELVDD based on the above Mathematical Formula 1. For example, when a low electric potential driving voltage ELVSS is a DC voltage of 0 V and a minimum drain-source voltage Vds.min of a fourth driving switching element Tdr4 at a gray level corresponding to the detected maximum voltage Vmax of 16 V is 7 V, the power supply unit 140 sets a sum (23 V) of the maximum voltage (Vmax: 16 V) and the minimum drain-source voltage Vds.min (7 V) as a value of the high electric potential driving voltage ELVDD in the predetermined horizontal period.

In the case where an initial high electric potential driving voltage ELVDD before correction is 28 V, a difference between the initial high electric potential driving voltage ELVDD (28 V) and the high electric potential driving voltage ELVDD (23 V) corrected in the predetermined horizontal period is 5 V. In other words, in the above predetermined horizontal period, the high electric potential driving voltage ELVDD is reduced from 28 V to 23 V. Accordingly, power consumption of the display device may be improved by about 18% in the above predetermined horizontal period.

In an exemplary embodiment of the present invention, as the high electric potential driving voltage ELVDD is reduced to 23 V in the above predetermined horizontal period, the drain-source voltages of respective driving switching elements Tdr1, Tdr2, Tdr3 and Tdr4 also change. The respective drain-source voltages of the driving switching elements Tdr1, Tdr2, Tdr3 and Tdr4 are determined based on the following Mathematical Formula 2.

$$VDS=ELVDD-VOLED \quad \text{<Mathematical Formula 2>}$$

In Mathematical Formula 2, VDS denotes a drain-source voltage of a driving switching element, and VOLED denotes a voltage of a light emitting element LED.

As illustrated in FIG. 8, in the case where the corrected high electric potential driving voltage ELVDD is 23 V and the voltage of the first light emitting element LED1 is 13 V, the drain-source voltage of the first driving switching element Tdr1 is determined to be 10 V (23 V-13 V). In addition, a drain-source voltage of the second driving switching element Tdr2 is determined to be 9 V (23 V-14 V), a drain-source voltage of the third driving switching element Tdr3 is determined to be 8 V (23 V-15 V), and a drain-source voltage of the fourth driving switching element Tdr4 is determined to be 7 V (23 V-16 V).

Referring to the drain-source voltages of the first, second, third and fourth driving switching elements Tdr1, Tdr2, Tdr3 and Tdr4, it can be seen that the fourth driving switching element Tdr4 of the fourth pixel PX4, which provides the maximum voltage Vmax in the above predetermined horizontal period, is set to have the aforementioned minimum drain-source voltage (Vds.min: 7 V).

Figure 9:
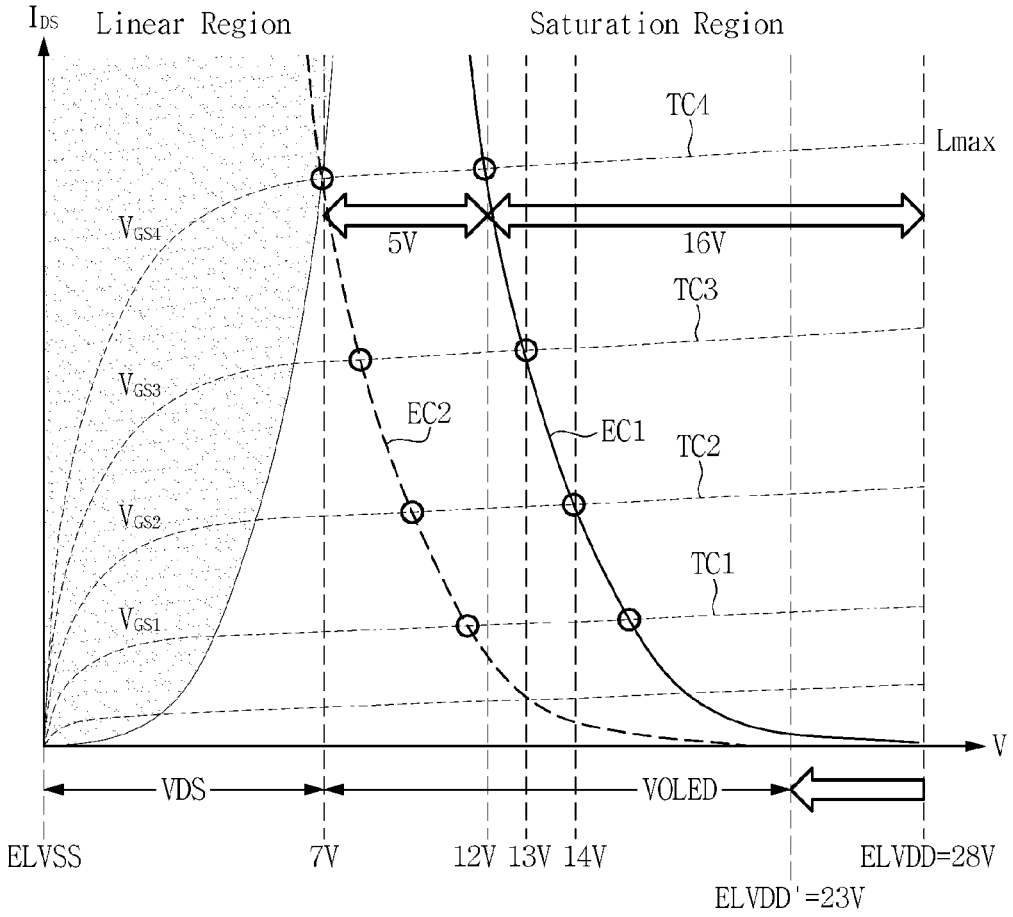
FIG. 9 is a graph illustrating a characteristic curve of a transistor and a characteristic curve of a light emitting element associated with a variation amount of the high electric potential driving voltage of FIG. 8 according to an exemplary embodiment of the present invention.

FIG. 9 is a graph illustrating a characteristic curve of a transistor and a characteristic curve of a light emitting element LED associated with a variation amount of the high electric potential driving voltage ELVDD of FIG. 8 according to an exemplary embodiment of the present invention.

In FIG. 9, each of transistor characteristic curves TC1, TC2, TC3, and TC4 is a transistor characteristic curve illustrating a variation of a drain-source current of a driving switching element according to a drain-source voltage thereof with respect to a gate-source voltage thereof.

For example, in the case where a difference voltage between a gate electrode and a source electrode of the first driving switching element Tdr1 has a level corresponding to a first gate-source voltage VGS1, the first transistor characteristic curve TC1 shows a variation of a drain-source current of the first driving switching element Tdr1 in accordance with a drain-source voltage of the first driving switching element Tdr1. In the case where a difference voltage between a gate electrode and a source electrode of the second driving switching element Tdr2 has a level corresponding to a second gate-source voltage VGS2, the second transistor characteristic curve TC2 shows a variation of a drain-source current of the second driving switching element Tdr2 in accordance with a drain-source voltage of the second driving switching element Tdr2. In the case where a difference voltage between a gate electrode and a source electrode of the third driving switching element Tdr3 has a level corresponding to a third gate-source voltage VGS3, the third transistor characteristic curve TC3 shows a variation of a drain-source current of the third driving switching element Tdr3 in accordance with a drain-source voltage of the third driving switching element Tdr3. Further, in the case where a difference voltage between a gate electrode and a source electrode of the fourth driving switching element Tdr4 has a level corresponding to a fourth gate-source voltage VGS4, the fourth transistor characteristic curve TC4 shows a variation of a drain-source current of the fourth driving switching element Tdr4 in accordance with a drain-source voltage of the fourth driving switching element Tdr4.

In an exemplary embodiment of the present invention, the gate-source voltage varies in accordance with a level (e.g., a gray level) of a data voltage. Accordingly, in FIG. 9, the first transistor characteristic curve TC1 corresponds to a drain-source voltage of a driving switching element used to generate a driving current IDS corresponding to a first gray level, the second transistor characteristic curve TC2 corresponds to a drain-source voltage of a driving switching element used to generate a driving current IDS corresponding to a second gray level, the third transistor characteristic curve TC3 corresponds to a drain-source voltage of a driving switching element used to generate a driving current IDS corresponding to a third gray level, and the fourth transistor characteristic curve TC4 corresponds to a drain-source voltage of a driving switching element used to generate a driving current IDS corresponding to a fourth gray level.

The drain-source voltage in each transistor characteristic curve is a drain-source voltage of the corresponding driving switching element in a saturation region.

The first gate-source voltage VGS1 of the first transistor characteristic curve TC1 corresponds to a first gray level, the second gate-source voltage VGS2 of the second transistor characteristic curve TC2 corresponds to a second gray level, the third gate-source voltage VGS3 of the third transistor characteristic curve TC3 corresponds to a third gray level, and the fourth gate-source voltage VGS4 of the fourth transistor characteristic curve TC4 corresponds to a fourth gray level Among the first, second, third and fourth gray levels, the first gray level is the lowest, and the fourth gray level is the highest. The second gray level is higher than the first gray level, the third gray level is higher than the second gray level, and the fourth gray level is higher than the third gray level. In an exemplary embodiment of the present invention, the fourth gray level is a gray level corresponding to a maximum voltage Vmax that has a highest voltage level among voltages of light emitting elements detected during a predetermined horizontal period. In other words, the fourth gray level corresponds to a luminance Lmax of a light generated from the fourth light emitting element LED4 that provides the maximum voltage Vmax among the four light emitting elements LED1, LED2, LED3 and LED4 in the predetermined horizontal period. The luminance of the light is the highest among luminances of lights respectively generated from the four light emitting elements LED1, LED2, LED3 and LED4 in the predetermined horizontal period.

In FIG. 9, EC1 and EC2 denote characteristic curves of a light emitting element LED illustrating a voltage variation of the light emitting element LED depending on the gray level.

As the high electric potential driving voltage ELVDD of 28 V is corrected to the high electric potential driving voltage ELVDD' of 23 V as described in reference to FIG. 8, a first light emitting element characteristic curve EC1 moves to the left as illustrated in FIG. 9. In other words, the first light emitting element characteristic curve EC1 is corrected to a second light emitting element characteristic curve EC2.

In an exemplary embodiment of the present invention, the first light emitting element characteristic curve EC1 is corrected based on the minimum drain-source voltage Vds.min of the fourth driving switching element Tdr4. For example, the minimum drain-source voltage Vds.min in the predetermined horizontal period is 7 V, and the minimum drain-source voltage Vds.min is at a boundary between a saturation region and a linear region of the driving switching element.

Figure 10:
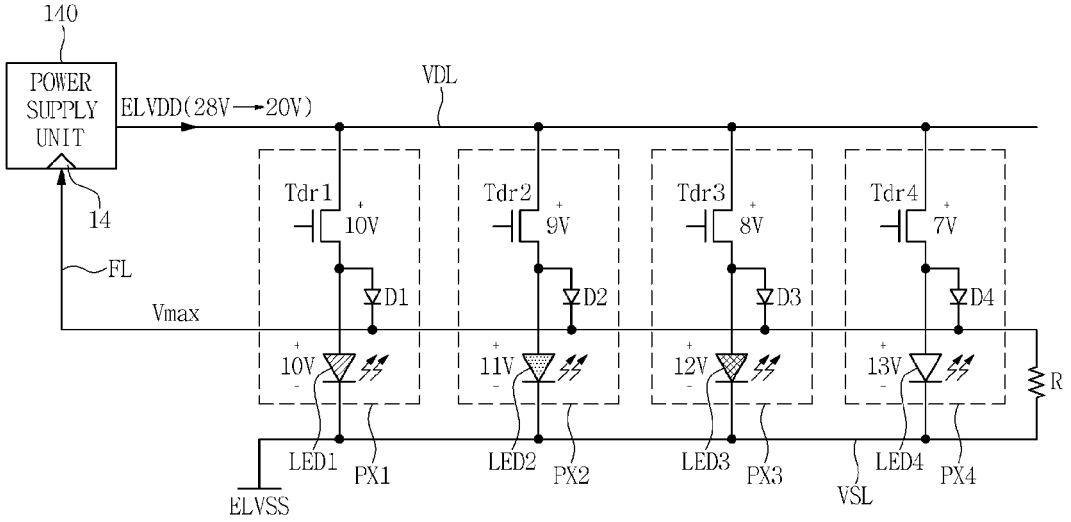
FIG. 10 is an explanatory view illustrating a method of correcting a high electric potential driving voltage based on a maximum voltage of a light emitting element detected from the first, second, third and fourth pixels according to an exemplary embodiment of the present invention and power consumption reducing effects according to the method.

FIG. 10 is an explanatory view illustrating a method of correcting the high electric potential driving voltage ELVDD based on the maximum voltage Vmax of a light emitting element detected from the first, second, third and fourth pixels according to an exemplary embodiment of the present invention and power consumption reducing effects according to the method.

As illustrated in FIG. 10, it is assumed that the display panel 110 includes four pixels PX1, PX2, PX3 and PX4 in total.

In the case where, in a predetermined horizontal period, a voltage of a first light emitting element LED1 included in the first pixel PX1 is 10 V, a voltage of the second light emitting element LED2 included in the second pixel PX2 is 11 V, a voltage of the third light emitting element LED3 included in the third pixel PX3 is 12 V, and a voltage of the fourth light emitting element LED4 included in the fourth pixel PX4 is 13 V, a maximum voltage Vmax among the voltages of the first, second, third and fourth light emitting elements LED1, LED2, LED3 and LED4 is 13 V. The maximum voltage Vmax of 13 V is applied to the power supply unit 140 through the feedback line FL.

Then, the power supply unit 140 sets a high electric potential driving voltage ELVDD based on the above Mathematical Formula 1. For example, when a low electric potential driving voltage ELVSS is a DC voltage of 0 V and a minimum drain-source voltage Vds.min of a fourth driving switching element Tdr4 at a gray level corresponding to the detected maximum voltage Vmax of 13 V is 7 V, the power supply unit 140 sets a sum (20 V) of the maximum voltage (Vmax: 13 V) and the minimum drain-source voltage Vds.min (7 V) as a value of the high electric potential driving voltage ELVDD in the predetermined horizontal period.

In the case where an initial high electric potential driving voltage ELVDD before correction is 28 V, a difference between the initial high electric potential driving voltage ELVDD (28 V) and the high electric potential driving voltage ELVDD (20V) corrected in the predetermined horizontal period is 8 V. In other words, in the above predetermined horizontal period, the high electric potential driving voltage ELVDD is reduced from 28 V to 20 V. Accordingly, power consumption of the display device may be improved by about 28% in the above predetermined horizontal period.

In an exemplary embodiment of the present invention, as the high electric potential driving voltage ELVDD is reduced to 20 V in the above predetermined horizontal period, the drain-source voltages of respective driving switching elements Tdr1, Tdr2, Tdr3 and Tdr4 also change. The respective drain-source voltages of the driving switching elements Tdr1, Tdr2, Tdr3 and Tdr4 are determined based on the above Mathematical Formula 2.

As illustrated in FIG. 10, in the case where the corrected high electric potential driving voltage ELVDD is 20 V and the voltage of the first light emitting element LED1 is 10 V, the drain-source voltage of the first driving switching element Tdr1 is 10 V (20 V-10 V). In this way, a drain-source voltage of the second driving switching element Tdr2 is 9 V (20 V-11 V), a drain-source voltage of the third driving switching element Tdr3 is 8 V (20 V-12 V), and a drain-source voltage of the fourth driving switching element Tdr4 is 7 V (20 V-13 V).

Referring to the drain-source voltages of the first, second, third and fourth driving switching elements Tdr1, Tdr2, Tdr3 and Tdr4, the fourth driving switching element Tdr4 of the fourth pixel PX4, which provides the maximum voltage Vmax in the above predetermined horizontal period, is set as the aforementioned minimum drain-source voltage (Vds.min: 7 V).

Figure 11:
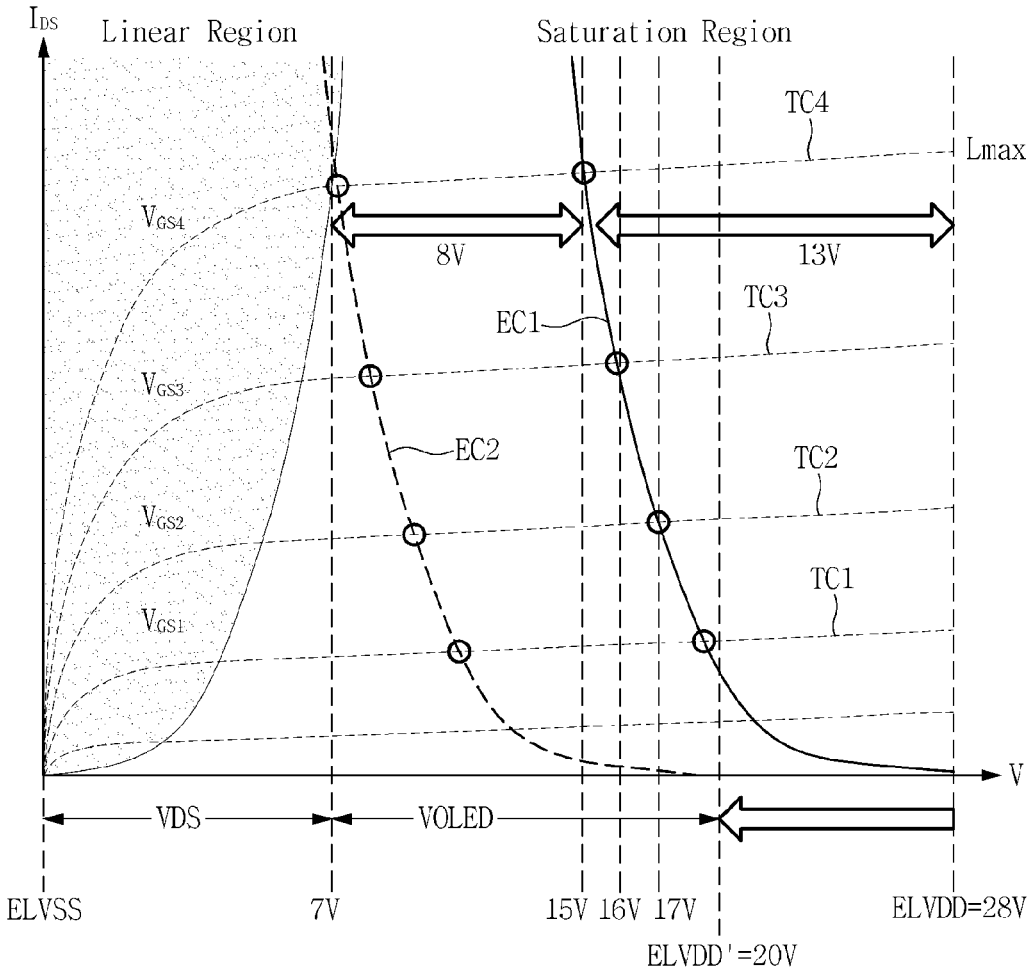
FIG. 11 is a graph illustrating a characteristic curve of a transistor and a characteristic curve of a light emitting element associated with a variation amount of the high electric potential driving voltage of FIG. 10 according to an exemplary embodiment of the present invention.

FIG. 11 is a graph illustrating a characteristic curve of a transistor and a characteristic curve of a light emitting element LED associated with a variation amount of the high electric potential driving voltage ELVDD of FIG. 10 according to an exemplary embodiment of the present invention.

In FIG. 11, each of transistor characteristic curves TC1, TC2, TC3, and TC4 is a transistor characteristic curve illustrating a variation of a drain-source current of a driving switching element according to a drain-source voltage thereof with respect to a gate-source voltage thereof.

For example, in the case where a difference voltage between a gate electrode and a source electrode of the first driving switching element Tdr1 has a level corresponding to a first gate-source voltage VGS1, the first transistor characteristic curve TC1 shows a variation of a drain-source current of the first driving switching element Tdr1 in accordance with a drain-source voltage of the first driving switching element Tdr1. In the case where a difference voltage between a gate electrode and a source electrode of the second driving switching element Tdr2 has a level corresponding to a second gate-source voltage VGS2, the second transistor characteristic curve TC2 shows a variation of a drain-source current of the second driving switching element Tdr2 in accordance with a drain-source voltage of the second driving switching element Tdr2. In the case where a difference voltage between a gate electrode and a source electrode of the third driving switching element Tdr3 has a level corresponding to a third gate-source voltage VGS3, the third transistor characteristic curve TC3 shows a variation of a drain-source current of the third driving switching element Tdr3 in accordance with a drain-source voltage of the third driving switching element Tdr3. Further, in the case where a difference voltage between a gate electrode and a source electrode of the fourth driving switching element Tdr4 has a level corresponding to a fourth gate-source voltage VGS4, the fourth transistor characteristic curve TC4 shows a variation of a drain-source current of the fourth driving switching element Tdr4 in accordance with a drain-source voltage of the fourth driving switching element Tdr4.

In an exemplary embodiment of the present invention, the gate-source voltage varies in accordance with a level (e.g., a gray level) of a data voltage. Accordingly, in FIG. 11, the first transistor characteristic curve TC1 corresponds to a drain-source voltage of a driving switching element used to generate a driving current IDS corresponding to a first gray level, the second transistor characteristic curve TC2 corresponds to a drain-source voltage of a driving switching element used to generate a driving current IDS corresponding to a second gray level, the third transistor characteristic curve TC3 corresponds to a drain-source voltage of a driving switching element used to generate a driving current IDS corresponding to a third gray level, and the fourth transistor characteristic curve TC4 corresponds to a drain-source voltage of a driving switching element used to generate a driving current IDS corresponding to a fourth gray level.

The drain-source voltage in each transistor characteristic curve refers to a drain-source voltage of the corresponding driving switching element in a saturation region.

The first gate-source voltage VGS1 of the first transistor characteristic curve TC1 corresponds to a first gray level, the second gate-source voltage VGS2 of the second transistor characteristic curve TC2 corresponds to a second gray level, the third gate-source voltage VGS3 of the third transistor characteristic curve TC3 corresponds to a third gray level, and the fourth gate-source voltage VGS4 of the fourth transistor characteristic curve TC4 corresponds to a fourth gray level Among the first, second, third and fourth gray levels, the first gray level is the lowest, and the fourth gray level is the highest. The second gray level is higher than the first gray level, the third gray level is higher than the second gray level, and the fourth gray level is higher than the third gray level. In an exemplary embodiment of the present invention, the fourth gray level is a gray level corresponding to a maximum voltage Vmax that has a highest voltage level among voltages of light emitting elements detected during a predetermined horizontal period. In other words, the fourth gray level corresponds to a luminance Lmax of a light generated from the fourth light emitting element LED4 that provides the maximum voltage Vmax among the four light emitting elements LED1, LED2, LED3 and LED4 in the predetermined horizontal period. The luminance of the light is the highest among luminances of lights respectively generated from the four light emitting elements LED1, LED2, LED3 and LED4 in the predetermined horizontal period.

In FIG. 11, EC1 and EC2 denote characteristic curves of a light emitting element LED illustrating a voltage variation of the light emitting element LED depending on the gray level.

As the high electric potential driving voltage ELVDD of 28 V is corrected to the high electric potential driving voltage ELVDD' of 20 V as in FIG. 10, a first light emitting element characteristic curve EC1 moves to the left as illustrated in FIG. 11. In other words, the first light emitting element characteristic curve EC1 is corrected to a second light emitting element characteristic curve EC2.

In an exemplary embodiment of the present invention, the first light emitting element characteristic curve EC1 is corrected based on the minimum drain-source voltage Vds.min of the fourth driving switching element Tdr4. For example, the minimum drain-source voltage Vds.min in the predetermined horizontal period is 7 V, and the minimum drain-source voltage Vds.min is at a boundary between a saturation region and a linear region of the fourth driving switching element Tdr4.

Figure 12:
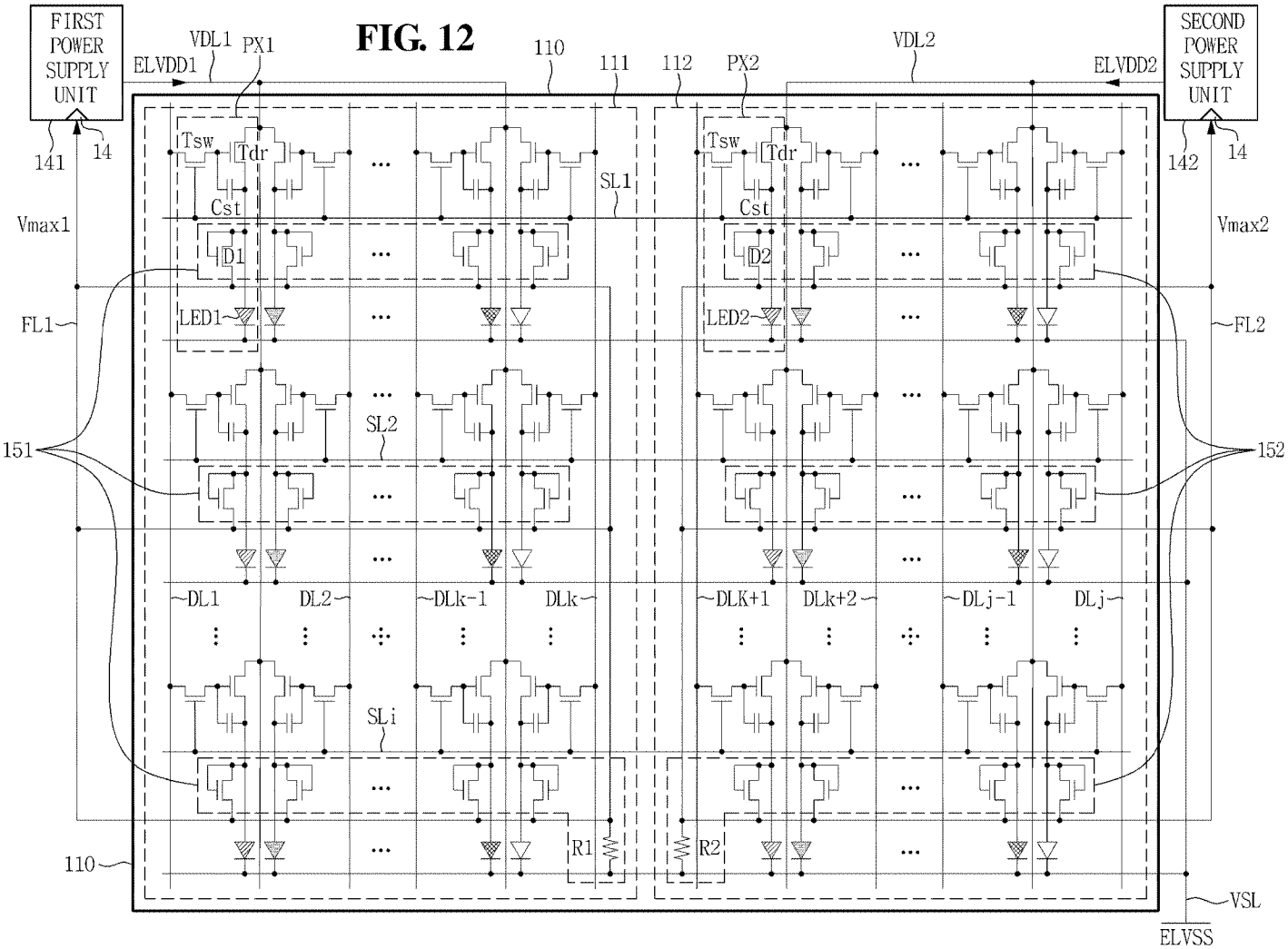
FIG. 12 is a detailed view illustrating the plurality of pixels and the maximum voltage detection unit of FIG. 1 according to an exemplary embodiment of the present invention.
Figure 13:
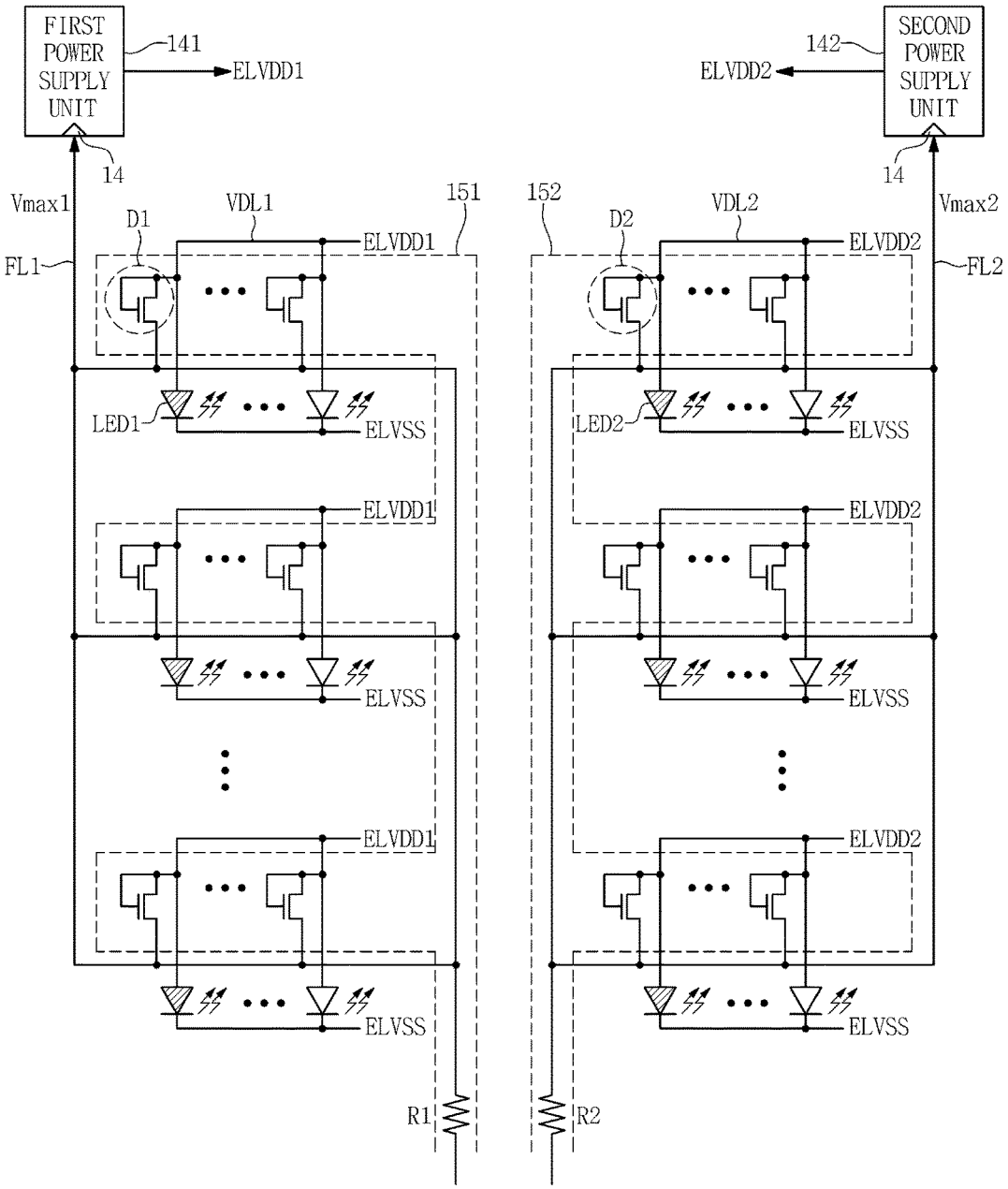
FIG. 13 is an explanatory view illustrating the relationship among first and second maximum voltage detection units and a light emitting element of each pixel of FIG. 12 according to an exemplary embodiment of the present invention.

FIG. 12 is a detailed view illustrating the plurality of pixels PX and the maximum voltage detection unit 150 of FIG. 1 according to an exemplary embodiment of the present invention, and FIG. 13 is an explanatory view illustrating the relationship among first and second maximum voltage detection units 151 and 152 and a light emitting element LED of each pixel PX of FIG. 12 according to an exemplary embodiment of the present invention.

A display panel 110 may include at least two display areas. For example, as illustrated in FIG. 12, the display panel 110 may include a first display area 111 and a second display area 112.

A plurality of first pixels PX1 are located in the first display area 111 and a plurality of second pixels PX2 are located in the second display area 112.

The first pixels PX1 may include at least one of a red pixel, a green pixel, a blue pixel, and a white pixel. The second pixels PX2 may include at least one of a red pixel, a green pixel, a blue pixel, and a white pixel. The red pixel includes a red light emitting element, the green pixel includes a green light emitting element, the blue pixel includes a blue light emitting element, and the white pixel includes a white light emitting element.

A power supply unit 140 may include a first power supply unit 141 and a second power supply unit 142.

The maximum voltage detection unit 150 may include a first maximum voltage detection unit 151 and a second maximum voltage detection unit 152.

The first maximum voltage detection unit 151 detects a greatest voltage among voltages of first light emitting elements LED1 provided in the first pixels PX1 in the first display area 111. To this end, the first maximum voltage detection unit 151 detects a voltage from each of the first light emitting elements LED1 in the respective first pixels PX1, and detects a greatest voltage (hereinafter, "a first maximum voltage Vmax1") that has a highest voltage level among the detected voltages and applies the detected first maximum voltage Vmax1 to the first power supply unit 141.

The first maximum voltage detection unit 151 includes a plurality of first diode-type elements D1 and at least one first resistor R1 as illustrated in FIGS. 12 and 13.

The plurality of first diode-type elements D1 and the first resistor R1 may be located in the first display area 111 of the display panel 110 as illustrated in FIG. 12. For example, the first diode-type elements D1 may be located on the first display area 111, one for each first pixel PX1.

The first diode-type element D1 may be a diode or a diode-type transistor, whose detailed descriptions were made with reference to FIG. 5.

Respective anode electrodes of the first diode-type elements D1 are individually connected to the first light emitting elements LED1 in the first display area 111, respectively.

Respective cathode electrodes of the first diode-type elements D1 are connected in common to a first feedback line FL1, as illustrated in FIGS. 12 and 13. The respective cathode electrodes of the first diode-type elements D1 are connected in common to a feedback input terminal 14 of the first power supply unit 141 through the first feedback line FL1.

The first resistor R1 is connected between the first feedback line FL1 and a low electric potential power line VSL, as illustrated in FIG. 12. The first resistor R1 is connected to the feedback input terminal 14 of the first power supply unit 141 through the first feedback line FL1. In addition, one terminal of the first resistor R1 is connected in common to the respective cathode electrodes of the first diode-type elements D1 through the first feedback line FL1.

The operation of the first maximum voltage detection unit 151 is substantially the same as that of the maximum voltage detection unit 150 described above.

An output voltage of the first power supply unit 141 may include a first high electric potential driving voltage ELVDD1 and a low electric potential driving voltage ELVSS.

The first high electric potential driving voltage ELVDD1 and the low electric potential driving voltage ELVSS output from the first power supply unit 141 are applied to the first display area 111 of the display panel 110. For example, the first high electric potential driving voltage ELVDD1 is applied to the first pixels PX1 of the first display area 111 through a first high electric potential power line VDL1, and the low electric potential driving voltage ELVSS is applied to the first pixels PX1 of the first display area 111 through a low electric potential power line VSL.

The first power supply unit 141 corrects the first high electric potential driving voltage ELVDD1 based on the first maximum voltage Vmax1 applied from the first maximum voltage detection unit 151 and outputs the corrected first high electric potential driving voltage ELVDD1 to the first high electric potential power line VDL1.

The operation of the first power supply unit 141 is substantially the same as that of the power supply unit 140 described above. For example, the first power supply unit 141 corrects the first high electric potential driving voltage ELVDD1 so that a difference voltage between the first high electric potential driving voltage ELVDD1 and the low electric potential driving voltage ELVSS becomes substantially equal to a sum of the first maximum voltage Vmax1 and a minimum drain-source voltage Vds.min of a driving switching element Tdr in the first pixel PX1.

As described above, two adjacent first pixels PX1 between a (2q−1)-th data line and a 2q-th data line among n-th horizontal line pixels PX may have a symmetrical shape with respect to the first high electric potential power line VDL1 passing through the two adjacent first pixels PX1.

The second maximum voltage detection unit 152 detects a greatest voltage among voltages of second light emitting elements LED2 provided in the second pixels PX2 in the second display area 112. For example, the second maximum voltage detection unit 152 detects a voltage from each of the second light emitting elements LED2 in the respective second pixels PX2, and detects a greatest voltage (hereinafter, "a second maximum voltage Vmax2") that has a highest voltage level among the detected voltages and applies the detected second maximum voltage Vmax2 to the second power supply unit 142.

The second maximum voltage detection unit 152 includes a plurality of second diode-type elements D2 and at least one second resistor R2 as illustrated in FIGS. 12 and 13.

The plurality of second diode-type elements D2 and the second resistor R2 may be located in the second display area 112 of the display panel 110 as illustrated in FIG. 12. For example, the second diode-type elements D2 may be located on the second display area 112, one for each second pixel PX2.

The second diode-type element D2 may be a diode or a diode-type transistor, whose detailed descriptions were made with reference to FIG. 5.

Respective anode electrodes of the second diode-type elements D2 are individually connected to the second light emitting elements LED2 in the second display area 112, respectively.

Respective cathode electrodes of the second diode-type elements D2 are connected in common to a second feedback line FL2, as illustrated in FIGS. 12 and 13. The respective cathode electrodes of the second diode-type elements D2 are connected in common to a feedback input terminal 14 of the second power supply unit 142 through the second feedback line FL2.

The second resistor R2 is connected between the second feedback line FL2 and the low electric potential power line VSL, as illustrated in FIG. 12. The second resistor R2 is connected to the feedback input terminal 14 of the second power supply unit 142 through the second feedback line FL2. In addition, one terminal of the second resistor R2 is connected in common to the respective cathode electrodes of the second diode-type elements D2 through the second feedback line FL2.

The operation of the second maximum voltage detection unit 152 is substantially the same as that of the maximum voltage detection unit 150 described above.

An output voltage of the second power supply unit 142 may include a second high electric potential driving voltage ELVDD2 and the low electric potential driving voltage ELVSS.

The second high electric potential driving voltage ELVDD2 and the low electric potential driving voltage ELVSS output from the second power supply unit 142 are applied to the second display area 112 of the display panel 110. For example, the second high electric potential driving voltage ELVDD2 is applied to the second pixels PX2 of the second display area 112 through a second high electric potential power line VDL2, and the low electric potential driving voltage ELVSS is applied to the second pixels PX2 of the second display area 112 through the low electric potential power line VSL.

The second power supply unit 142 corrects the second high electric potential driving voltage ELVDD2 based on the second maximum voltage Vmax2 applied from the second maximum voltage detection unit 152 and outputs the corrected second high electric potential driving voltage ELVDD2 to the second high electric potential power line VDL2.

The operation of the second power supply unit 142 is substantially the same as that of the power supply unit 140 described above. For example, the second power supply unit 142 corrects the second high electric potential driving voltage ELVDD2 so that a difference voltage between the second high electric potential driving voltage ELVDD2 and the low electric potential driving voltage ELVSS becomes substantially equal to a sum of the second maximum voltage Vmax2 and a minimum drain-source voltage Vds.min of a driving switching element Tdr in the second pixel PX2.

As described above, two adjacent second pixels PX2 between the (2q−1)-th data line and the 2q-th data line among the n-th horizontal line pixels PX may have symmetry with respect to the second high electric potential power line VDL2 passing between the two adjacent second pixels PX2.

Figure 14:
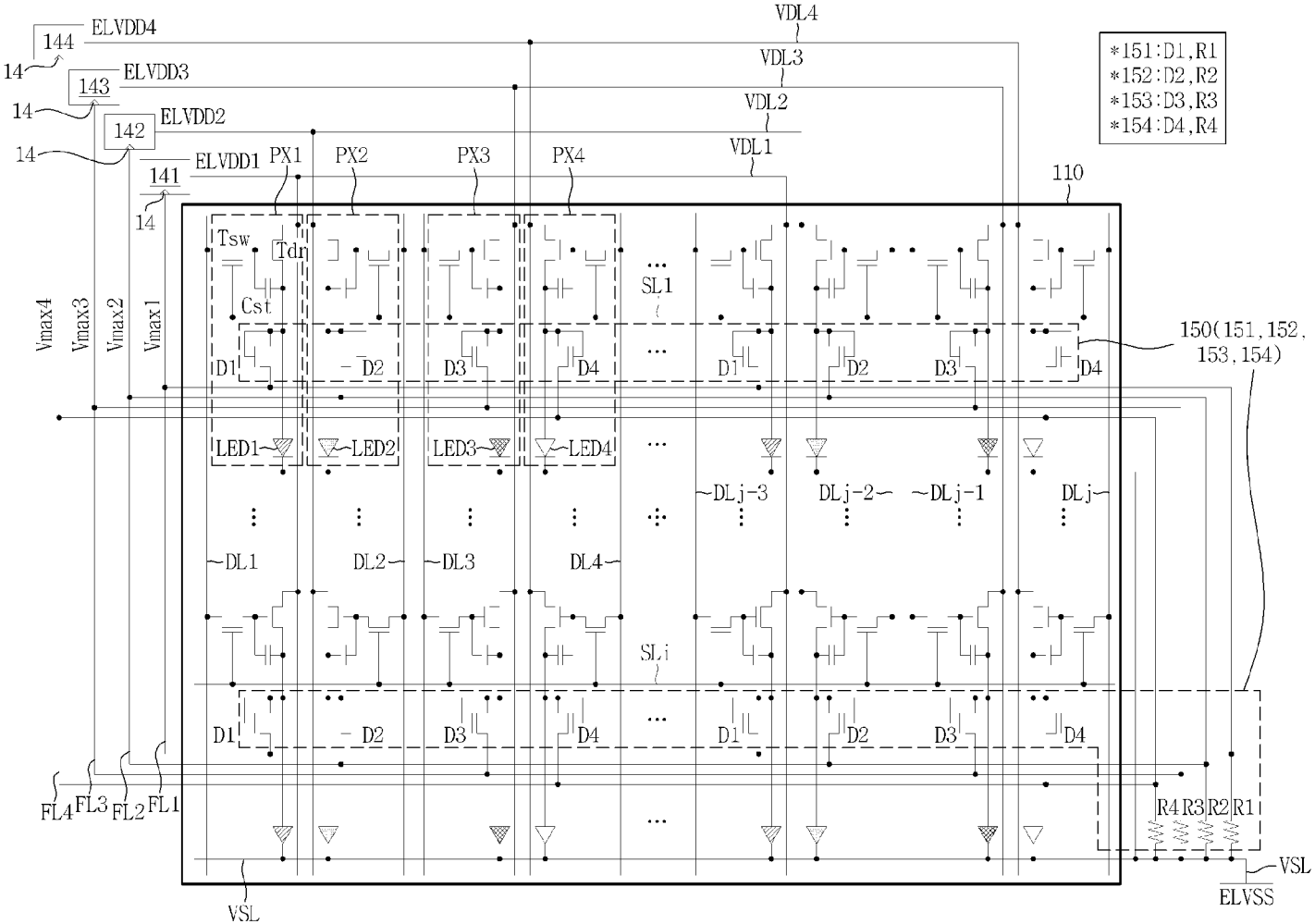
FIG. 14 is a detailed view illustrating the plurality of pixels and the maximum voltage detection unit of FIG. 1 according to an exemplary embodiment of the present invention.
Figure 15:
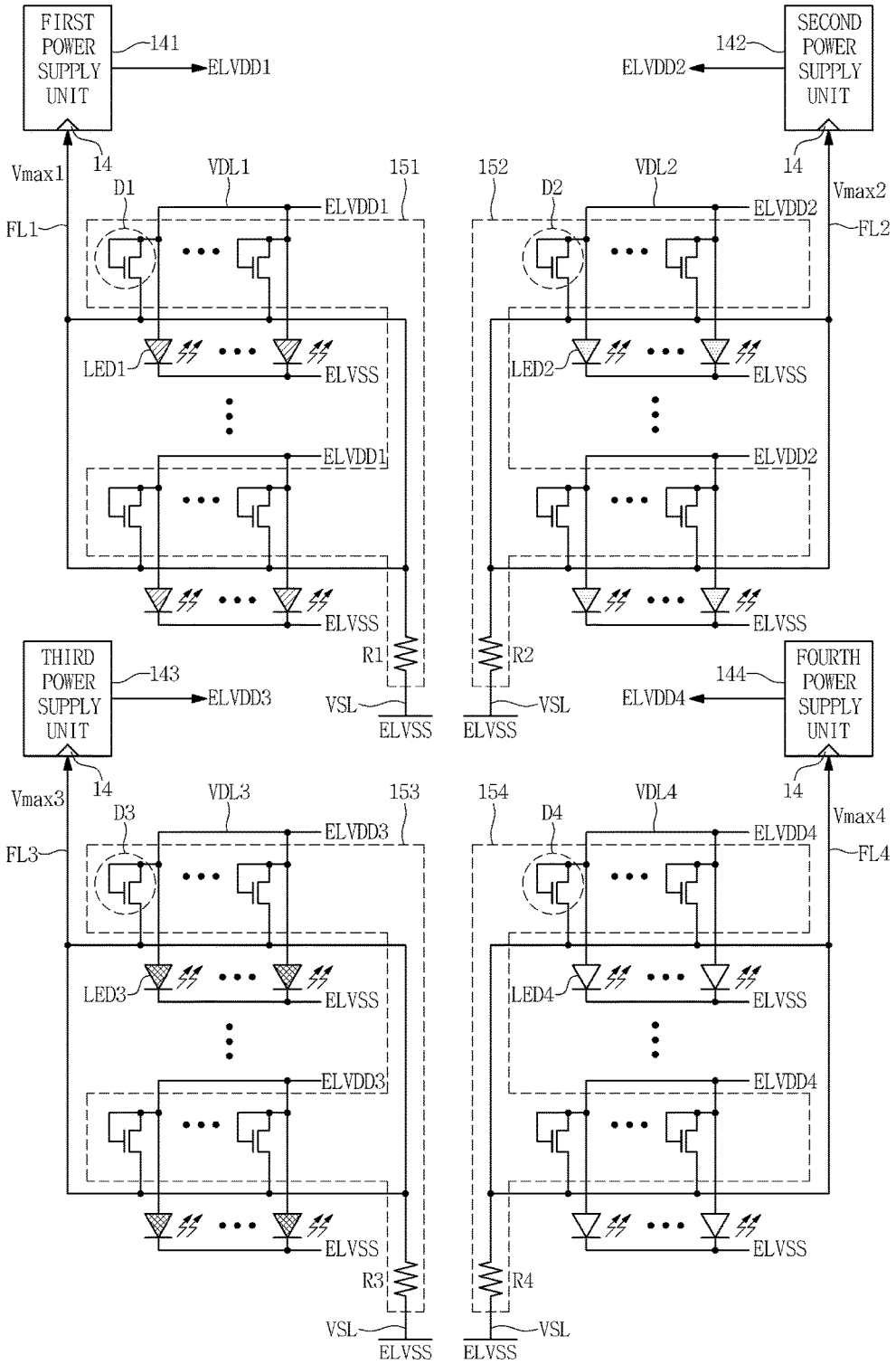
FIG. 15 is an explanatory view illustrating the relationship among first, second, third and fourth maximum voltage detection units and a light emitting element of each pixel of FIG. 14 according to an exemplary embodiment of the present invention.

FIG. 14 is a detailed view illustrating the plurality of pixels PX and the maximum voltage detection unit 150 of FIG. 1 according to an exemplary embodiment of the present invention, and FIG. 15 is an explanatory view illustrating the relationship among first, second, third and fourth maximum voltage detection units 151, 152, 153 and 154 and a light emitting element LED of each pixel PX of FIG. 14 according to an exemplary embodiment of the present invention.

A display panel 110 of FIG. 14 is substantially the same as the display panel 110 of FIG. 3 described above.

As illustrated in FIGS. 14 and 15, a power supply unit 140 may include a first power supply unit 141, a second power supply unit 142, a third power supply unit 143 and a fourth power supply unit 144.

The maximum voltage detection unit 150 may include a first maximum voltage detection unit 151, a second maximum voltage detection unit 152, a third maximum voltage detection unit 153, and a fourth maximum voltage detection unit 154.

The first maximum voltage detection unit 151 detects a greatest voltage among respective voltages of red light emitting elements LED1 respectively provided in red pixels PX1 in the display panel 110. To accomplish this, the first maximum voltage detection unit 151 detects a voltage from each of the red light emitting elements LED1 in the respective red pixels PX1, and detects a greatest voltage (hereinafter, "a first maximum voltage Vmax1") that has a highest voltage level among the detected voltages and applies the detected first maximum voltage Vmax1 to the first power supply unit 141.

The first maximum voltage detection unit 151 includes a plurality of first diode-type elements D1 and at least one first resistor R1 as illustrated in FIGS. 14 and 15.

The plurality of first diode-type elements D1 may be located on the display panel 110 as illustrated in FIG. 14. For example, the first diode-type elements D1 may be located on the display panel 110, one for each red pixel PX1. The first resistor R1 may be disposed away from the display panel 110.

The first diode-type element D1 may be a diode or a diode-type transistor, whose detailed descriptions were made reference to FIG. 5.

Respective anode electrodes of the first diode-type elements D1 are individually connected to the red light emitting elements LED1, respectively.

Respective cathode electrodes of the first diode-type elements D1 are connected in common to a first feedback line FL1, as illustrated in FIGS. 14 and 15. The respective cathode electrodes of the first diode-type elements D1 are connected in common to a feedback input terminal 14 of the first power supply unit 141 through the first feedback line FL1.

The first resistor R1 is connected between the first feedback line FL1 and a low electric potential power line VSL, as illustrated in FIGS. 14 and 15. The first resistor R1 is connected to the feedback input terminal 14 of the first power supply unit 141 through the first feedback line FL1.

In addition, one terminal of the first resistor R1 is connected in common to the respective cathode electrodes of the first diode-type elements D1 through the first feedback line FL1.

The operation of the first maximum voltage detection unit 151 is substantially the same as that of the maximum voltage detection unit 150 described above.

An output voltage of the first power supply unit 141 may include a first high electric potential driving voltage ELVDD1 and a low electric potential driving voltage ELVSS.

The first high electric potential driving voltage ELVDD1 and the low electric potential driving voltage ELVSS output from the first power supply unit 141 are applied to the display panel 110. For example, the first high electric potential driving voltage ELVDD1 is applied to the red pixels PX1 of the display panel 110 through a first high electric potential power line VDL1, and the low electric potential driving voltage ELVSS is applied to the red pixels PX1 of the display panel 110 through a low electric potential power line VSL.

The first power supply unit 141 corrects the first high electric potential driving voltage ELVDD1 based on the first maximum voltage Vmax1 applied from the first maximum voltage detection unit 151 and outputs the corrected first high electric potential driving voltage ELVDD1 to the first high electric potential power line VDL1.

The operation of the first power supply unit 141 is substantially the same as that of the power supply unit 140 described above. For example, the first power supply unit 141 corrects the first high electric potential driving voltage ELVDD1 so that a difference voltage between the first high electric potential driving voltage ELVDD1 and the low electric potential driving voltage ELVSS becomes substantially equal to a sum of the first maximum voltage Vmax1 and a minimum drain-source voltage Vds.min of a driving switching element Tdr in the red pixel PX1.

As described above, a red pixel PX1 and a green pixel PX2 adjacent to each other between a (2q−1)-th data line and a 2q-th data line among n-th horizontal line pixels PX may have symmetry with respect to the first high electric potential power line VDL1 between the red pixel PX1 and the green pixel PX2.

The second maximum voltage detection unit 152 detects a greatest voltage among respective voltages of green light emitting elements LED2 respectively provided in green pixels PX2 in the display panel 110. To accomplish this, the second maximum voltage detection unit 152 detects a voltage from each of the green light emitting elements LED2 in the respective green pixels PX2, and detects a greatest voltage (hereinafter, "a second maximum voltage Vmax2") that has a highest voltage level among the detected voltages and applies the detected second maximum voltage Vmax2 to the second power supply unit 142.

The second maximum voltage detection unit 152 includes a plurality of second diode-type elements D2 and at least one second resistor R2 as illustrated in FIGS. 14 and 15.

The plurality of second diode-type elements D2 may be located on the display panel 110 as illustrated in FIG. 14. For example, the second diode-type elements D2 may be located on the display panel 110, one for each green pixel PX2. The second resistor R2 may be disposed away from the display panel 110.

The second diode-type element D2 may be a diode or a diode-type transistor, whose detailed descriptions were made with reference to FIG. 5.

Respective anode electrodes of the second diode-type elements D2 are individually connected to the green light emitting elements LED2, respectively.

Respective cathode electrodes of the second diode-type elements D2 are connected in common to a second feedback line FL2, as illustrated in FIGS. 14 and 15. The respective cathode electrodes of the second diode-type elements D2 are connected in common to a feedback input terminal 14 of the second power supply unit 142 through the second feedback line FL2.

The second resistor R2 is connected between the second feedback line FL2 and the low electric potential power line VSL, as illustrated in FIGS. 14 and 15. The second resistor R2 is connected to the feedback input terminal 14 of the second power supply unit 142 through the second feedback line FL2. In addition, one terminal of the second resistor R2 is connected in common to the respective cathode electrodes of the second diode-type elements D2 through the second feedback line FL2.

The operation of the second maximum voltage detection unit 152 is substantially the same as that of the maximum voltage detection unit 150 described above.

An output voltage of the second power supply unit 142 may include a second high electric potential driving voltage ELVDD2 and the low electric potential driving voltage ELVSS.

The second high electric potential driving voltage ELVDD2 and the low electric potential driving voltage ELVSS output from the second power supply unit 142 are applied to the display panel 110. For example, the second high electric potential driving voltage ELVDD2 is applied to the green pixels PX2 of the display panel 110 through a second high electric potential power line VDL2, and the low electric potential driving voltage ELVSS is applied to the green pixels PX2 of the display panel 110 through the low electric potential power line VSL.

The second power supply unit 142 corrects the second high electric potential driving voltage ELVDD2 based on the second maximum voltage Vmax2 applied from the second maximum voltage detection unit 152 and outputs the corrected second high electric potential driving voltage ELVDD2 to the second high electric potential power line VDL2.

The operation of the second power supply unit 142 is substantially the same as that of the power supply unit 140 described above. For example, the second power supply unit 142 corrects the second high electric potential driving voltage ELVDD2 so that a difference voltage between the second high electric potential driving voltage ELVDD2 and the low electric potential driving voltage ELVSS becomes substantially equal to a sum of the second maximum voltage Vmax2 and a minimum drain-source voltage Vds.min of a driving switching element Tdr in the green pixel PX2.

As described above, the red pixel PX1 and the green pixel PX2 adjacent to each other between the (2q−1)-th data line and the 2q-th data line among the n-th horizontal line pixels PX may have symmetry with respect to the second high electric potential power line VDL2 between the red pixel PX1 and the green pixel PX2.

The third maximum voltage detection unit 153 detects a greatest voltage among respective voltages of blue light emitting elements LED3 respectively provided in blue pixels PX3 in the display panel 110. To accomplish this, the third maximum voltage detection unit 153 detects a voltage from each of the blue light emitting elements LED3 in the respective blue pixels PX3, and detects a greatest voltage (hereinafter, "a third maximum voltage Vmax3") that has a highest voltage level among the detected voltages and applies the detected third maximum voltage Vmax3 to the third power supply unit 143.

The third maximum voltage detection unit 153 includes a plurality of third diode-type elements D3 and at least one third resistor R3 as illustrated in FIGS. 14 and 15.

The plurality of third diode-type elements D3 may be located on the display panel 110 as illustrated in FIG. 14. For example, the third diode-type elements D3 may be located on the display panel 110, one for each blue pixel PX3. The third resistor R3 may be disposed away from the display panel 110.

The third diode-type element D3 may be a diode or a diode-type transistor, whose detailed descriptions were made with reference to FIG. 5.

Respective anode electrodes of the third diode-type elements D3 are individually connected to the blue light emitting elements LED3, respectively.

Respective cathode electrodes of the third diode-type elements D3 are connected in common to a third feedback line FL3, as illustrated in FIGS. 14 and 15. The respective cathode electrodes of the third diode-type elements D3 are connected in common to a feedback input terminal 14 of the third power supply unit 143 through the third feedback line FL3.

The third resistor R3 is connected between the third feedback line FL3 and the low electric potential power line VSL, as illustrated in FIGS. 14 and 15. The third resistor R3 is connected to the feedback input terminal 14 of the third power supply unit 143 through the third feedback line FL3. In addition, one terminal of the third resistor R3 is connected in common to the respective cathode electrodes of the third diode-type elements D3 through the third feedback line FL3.

The operation of the third maximum voltage detection unit 153 is substantially the same as that of the maximum voltage detection unit 150 described above.

An output voltage of the third power supply unit 143 may include a third high electric potential driving voltage ELVDD3 and the low electric potential driving voltage ELVSS.

The third high electric potential driving voltage ELVDD3 and the low electric potential driving voltage ELVSS output from the third power supply unit 143 are applied to the display panel 110. For example, the third high electric potential driving voltage ELVDD3 is applied to the blue pixels PX3 of the display panel 110 through a third high electric potential power line VDL3, and the low electric potential driving voltage ELVSS is applied to the blue pixels PX3 of the display panel 110 through the low electric potential power line VSL.

The third power supply unit 143 corrects the third high electric potential driving voltage ELVDD3 based on the third maximum voltage Vmax3 applied from the third maximum voltage detection unit 153 and outputs the corrected third high electric potential driving voltage ELVDD3 to the third high electric potential power line VDL3.

The operation of the third power supply unit 143 is substantially the same as that of the power supply unit 140 described above. For example, the third power supply unit 143 corrects the third high electric potential driving voltage ELVDD3 so that a difference voltage between the third high electric potential driving voltage ELVDD3 and the low electric potential driving voltage ELVSS becomes substantially equal to a sum of the third maximum voltage Vmax3 and a minimum drain-source voltage Vds.min of a driving switching element Tdr in the blue pixel PX3.

As described above, a blue pixel PX3 and a white pixel PX4 adjacent to each other between the (2q−1)-th data line and the 2q-th data line among the n-th horizontal line pixels PX may have symmetry with respect to the third high electric potential power line VDL3 between the blue pixel PX3 and the white pixel PX4.

The fourth maximum voltage detection unit 154 detects a greatest voltage among respective voltages of white light emitting elements LED4 respectively provided in white pixels PX4 in the display panel 110. To accomplish this, the fourth maximum voltage detection unit 154 detects a voltage from each of the white light emitting elements LED4 in the respective white pixels PX4, and detects a greatest voltage (hereinafter, "a fourth maximum voltage Vmax4") that has a highest voltage level among the detected voltages and applies the detected fourth maximum voltage Vmax4 to the fourth power supply unit 144.

The fourth maximum voltage detection unit 154 includes a plurality of fourth diode-type elements D4 and at least one fourth resistor R4 as illustrated in FIGS. 14 and 15.

The plurality of fourth diode-type elements D4 may be located on the display panel 110 as illustrated in FIG. 14. For example, the fourth diode-type elements D4 may be located on the display panel 110, one for each white pixel PX4. The fourth resistor R4 may be disposed away from the display panel 110.

The fourth diode-type element D4 may be a diode or a diode-type transistor, whose detailed descriptions were made with reference to FIG. 5.

Respective anode electrodes of the fourth diode-type elements D4 are individually connected to the white light emitting elements LED4, respectively.

Respective cathode electrodes of the fourth diode-type elements D4 are connected in common to a fourth feedback line FL4, as illustrated in FIGS. 14 and 15. The respective cathode electrodes of the fourth diode-type elements D4 are connected in common to a feedback input terminal 14 of the fourth power supply unit 144 through the fourth feedback line FL4.

The fourth resistor R4 is connected between the fourth feedback line FL4 and the low electric potential power line VSL, as illustrated in FIGS. 14 and 15. The fourth resistor R4 is connected to the feedback input terminal 14 of the fourth power supply unit 144 through the fourth feedback line FL4. In addition, one terminal of the fourth resistor R4 is connected in common to the respective cathode electrodes of the fourth diode-type elements D4 through the fourth feedback line FL4.

The operation of the fourth maximum voltage detection unit 154 is substantially the same as that of the maximum voltage detection unit 150 described above.

An output voltage of the fourth power supply unit 144 may include a fourth high electric potential driving voltage ELVDD4 and the low electric potential driving voltage ELVSS.

The fourth high electric potential driving voltage ELVDD4 and the low electric potential driving voltage ELVSS output from the fourth power supply unit 144 are applied to the display panel 110. For example, the fourth high electric potential driving voltage ELVDD4 is applied to the white pixels PX4 of the display panel 110 through a fourth high electric potential power line VDL4, and the low electric potential driving voltage ELVSS is applied to the white pixels PX4 of the display panel 110 through the low electric potential power line VSL.

The fourth power supply unit 144 corrects the fourth high electric potential driving voltage ELVDD4 based on the fourth maximum voltage Vmax4 applied from the fourth maximum voltage detection unit 154 and outputs the corrected fourth high electric potential driving voltage ELVDD4 to the fourth high electric potential power line VDL4.

The operation of the fourth power supply unit 144 is substantially the same as that of the power supply unit 140 described above. For example, the fourth power supply unit 144 corrects the fourth high electric potential driving voltage ELVDD4 so that a difference voltage between the fourth high electric potential driving voltage ELVDD4 and the low electric potential driving voltage ELVSS becomes substantially equal to a sum of the fourth maximum voltage Vmax4 and a minimum drain-source voltage Vds.min of a driving switching element Tdr in the white pixel PX4.

As described above, the blue pixel PX3 and the white pixel PX4 adjacent to each other between the (2q−1)-th data line and the 2q-th data line among the n-th horizontal line pixels PX may have symmetry with respect to the fourth high electric potential power line VDL4 passing between the blue pixel PX3 and the white pixel PX4.

In an exemplary embodiment of the present invention, the red pixel PX1, the green pixel PX2 and the blue pixel PX3 may be connected in common to one high electric potential driving power line and the white pixel PX4 may be connected to another high electric potential driving power line.

Figure 16:
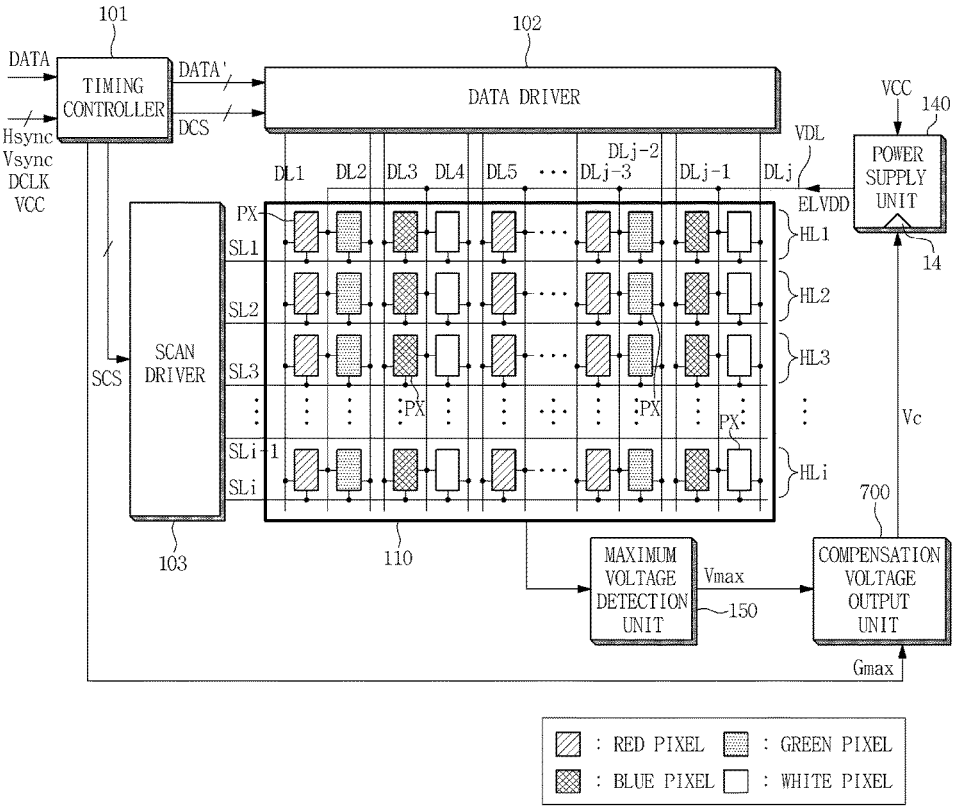
FIG. 16 is a block diagram illustrating a light emitting display device according to an exemplary embodiment of the present invention.
Figure 17:
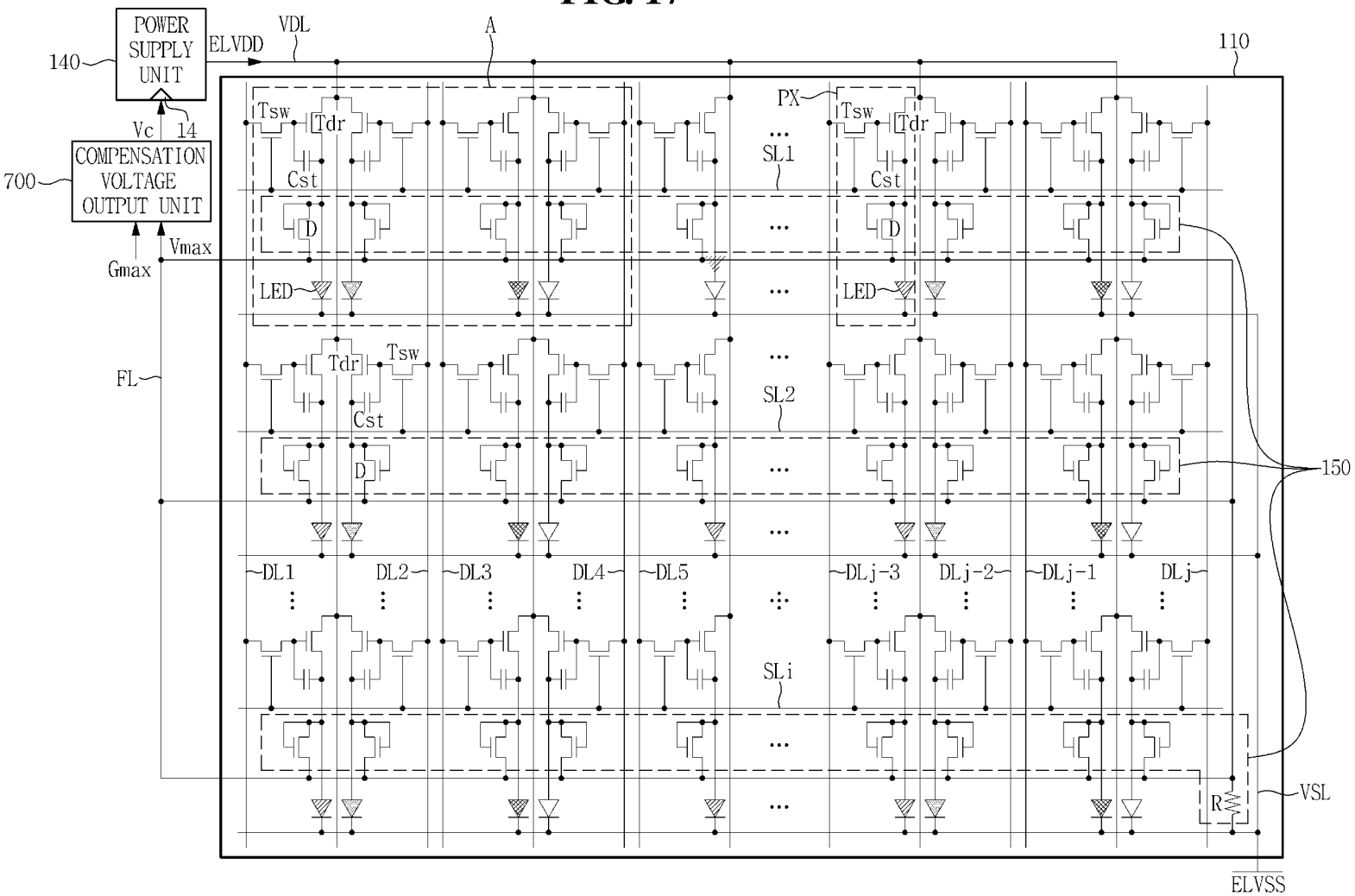
FIG. 17 is an explanatory view illustrating the relationship among a maximum voltage detection unit, a compensation value output unit, and a light emitting element of each pixel in FIG. 16 according to an exemplary embodiment of the present invention.

FIG. 16 is a block diagram illustrating a light emitting display device according to an exemplary embodiment of the present invention, and FIG. 17 is an explanatory view illustrating the relationship among a maximum voltage detection unit 150, a compensation voltage output unit 700, and a light emitting element LED of each pixel PX in FIG. 16 according to an exemplary embodiment of the present invention.

As illustrated in FIG. 16, the display device includes a display panel 110, a timing controller 101, a scan driver 103, a data driver 102, a power supply unit 140, a maximum voltage detection unit 150, and a compensation voltage output unit 700.

The display panel 110, the scan driver 103, the data driver 102, and the maximum voltage detection unit 150 of FIG. 16 are substantially the same as the display panel 110, the scan driver 103, the data driver 102, and the maximum voltage detection unit 150 of FIG. 1, and thus, repetitive descriptions thereof may be omitted.

The timing controller 101 of FIG. 16 performs the following operation in addition to the above-described operation of the timing controller 101 of FIG. 1. For example, the timing controller 101 of FIG. 16 outputs an image data signal having a highest gray level (hereinafter, "a highest gray level image data signal Gmax") among image data signals applied to all of the pixels PX of the display panel 110. In an exemplary embodiment of the present invention, the highest gray level image data signal Gmax does not always correspond to, for example, a gray level 255, which is a highest gray level among a gray level 0 to a gray level 255. In other words, the highest gray level image data signal Gmax refers to an image data signal having a highest gray level among image data signals included in a screen data of one horizontal period. Thus, depending on the configuration of the screen data, an image data signal having a highest gray level in each horizontal period may have one selected from a gray level 0 to a gray level 255.

The aforementioned screen data is different from a frame data. In other words, as in the above descriptions made with reference to FIGS. 7A, 7B and 7C, one screen data in one horizontal period may include image data signals of a previous frame period in addition to image data signals of a current frame period.

The timing controller 101 of FIG. 16 detects the highest gray level image data signal Gmax based on the screen data updated on the basis of a horizontal period. The maximum voltage detection unit 150 of FIGS. 1 and 16 detects a maximum voltage Vmax based on data voltages of one screen corresponding to the screen data updated on the basis of the horizontal period. Accordingly, the highest gray level image data signal Gmax and the maximum voltage Vmax detected in a same horizontal period have a substantially same gray level.

However, in a same horizontal period, the gray level of the highest gray level image data signal Gmax does not always coincide with a gray level of the maximum voltage Vmax. For example, in the case where a light emitting element of a single pixel among a plurality of pixels PX emits light of a predetermined gray level and the remaining pixels all have a gray level 0, e.g., the remaining pixels are turned off, a feedback line FL may not be charged sufficiently in one horizontal period. In this case, because the feedback line FL is only charged by a driving current generated from the light emitting element of the single pixel, a voltage of the feedback line FL may not reach a target voltage (e.g., the maximum voltage Vmax) in the one horizontal period. In this case, the maximum voltage Vmax in the one horizontal period may not coincide with the highest gray level image data signal Gmax which is a digital signal corresponding to the maximum voltage Vmax. However, since it is a rare case that only one pixel PX is turned on, the highest gray level image data signal Gmax and the maximum voltage Vmax detected in the same horizontal period may have substantially the same gray level. In other words, a highest gray level image data signal Gmax detected in a predetermined horizontal period may be used to identify a gray level of a maximum voltage Vmax in the predetermined horizontal period.

As illustrated in FIG. 17, the maximum voltage detection unit 150 of FIG. 16 includes a plurality of diode-type elements D and at least one resistor R. The maximum voltage detection unit 150 of FIG. 17 is substantially the same as the maximum voltage detection unit 150 of FIG. 1 described above. However, the maximum voltage detection unit 150 of FIGS. 16 and 17 provides the maximum voltage Vmax generated from the maximum voltage detection unit 150 to the compensation voltage output unit 700 instead of the power supply unit 140. For example, the maximum voltage Vmax output from the maximum voltage detection unit 150 is applied to the compensation voltage output unit 700 through the feedback line FL. In addition, the compensation voltage output unit 700 receives a compensation voltage of the feedback line FL through a feedback input terminal thereof.

The compensation voltage output unit 700 stores compensation voltages corresponding to each gray level of the image data signal. For example, in the case where the image data signal has a gray level selected from a gray level 0 to a gray level 255, 256 compensation voltages from the gray level 0 to the gray level 255 are stored in advance in the compensation voltage output unit 700.

The compensation voltage output unit 700 receives the maximum voltage Vmax from the maximum voltage detection unit 150 and receives the highest gray level image data signal Gmax from the timing controller 101.

The compensation voltage output unit 700 refers to the highest gray level image data signal Gmax to identify a gray level of the maximum voltage Vmax. In other words, as described above, the highest gray level image data signal Gmax and the maximum voltage Vmax detected in a same horizontal period have substantially the same gray level.

The compensation voltage output unit 700 corrects at least one of the compensation voltages based on the maximum voltage Vmax. For example, the compensation voltage output unit 700 corrects the compensation voltage corresponding to the highest gray level image data signal Gmax.

In addition, the compensation voltage output unit 700 selects a compensation voltage Vc corresponding to the highest gray level image data signal Gmax applied from the timing controller 101 and applies the selected compensation voltage Vc to the power supply unit 140.

The power supply unit 140 corrects a high electric potential driving voltage ELVDD based on the compensation voltage Vc provided from the compensation voltage output unit 700 and applies the corrected high electric potential driving voltage ELVDD to a high electric potential power line VDL. For example, as in the above Mathematical Formula 1, the power supply unit 140 corrects the high electric potential driving voltage ELVDD so that a difference voltage between the high electric potential driving voltage ELVDD and a low electric potential driving voltage ELVSS becomes substantially equal to a sum of the compensation voltage Vc and a minimum drain-source voltage Vds.min of a driving switching element Tdr.

Figure 18:
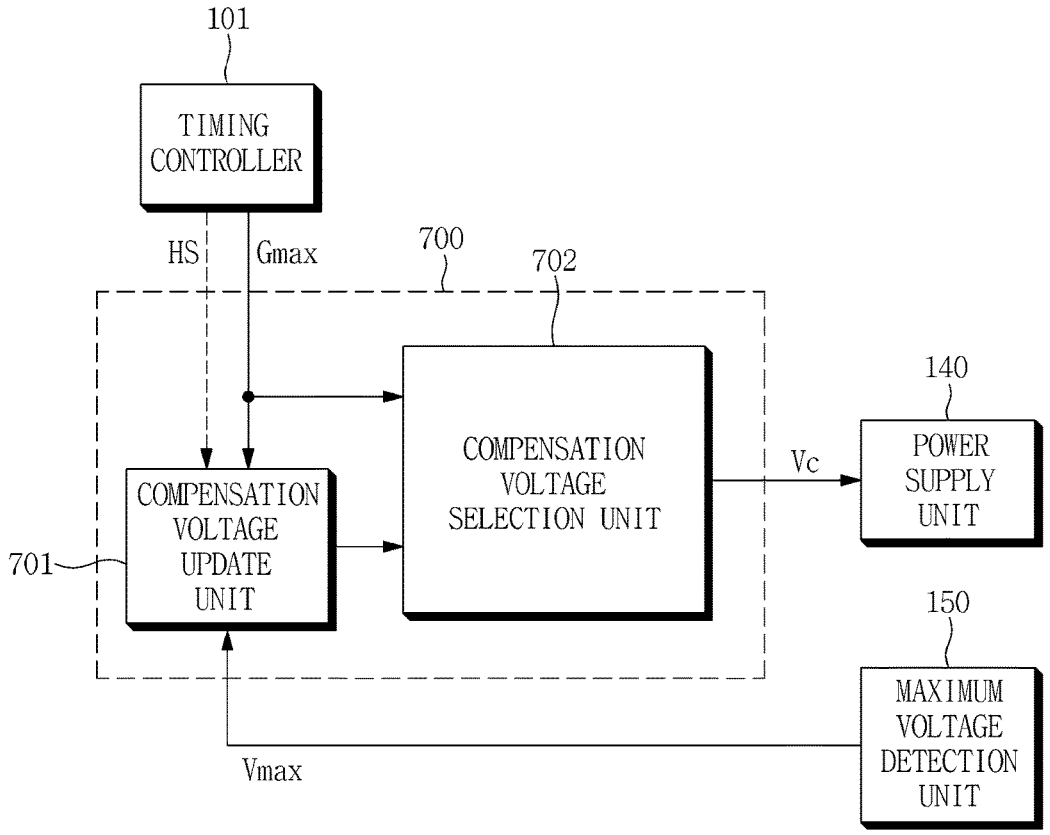
FIG. 18 is a detailed block diagram illustrating the compensation value output unit of FIG. 16 according to an exemplary embodiment of the present invention.

FIG. 18 is a detailed block diagram illustrating the compensation value output unit 700 of FIG. 16 according to an exemplary embodiment of the present invention.

As illustrated in FIG. 18, the compensation voltage output unit 700 may include a compensation voltage selection unit 702 and a compensation voltage update unit 701.

The compensation voltage selection unit 700 stores compensation voltages corresponding to each gray level of the image data signal. For example, in the case where the image data signal has a gray level selected from a gray level 0 to a gray level 255, 256 compensation voltages from the gray level 0 to the gray level 255 are stored in advance in the compensation voltage output unit 700.

The compensation voltage selection unit 702 receives the highest gray level image data signal Gmax from the timing controller 101. Since the highest gray level image data signal Gmax is output every horizontal period, the compensation voltage selection unit 702 receives the highest gray level image data signal Gmax in each horizontal period. The compensation voltage selection unit 702 outputs the compensation voltage Vc each time the highest gray level image data signal Gmax is input. For example, the compensation voltage selection unit 702 selects a compensation voltage Vc corresponding to the highest gray level image data signal Gmax among the compensation voltages stored therein, and applies the selected compensation voltage Vc to the power supply unit 140.

The compensation voltage selection unit 702 may be a lookup table in which the aforementioned compensation voltages are stored.

The compensation voltage update unit 701 periodically corrects the compensation voltages stored in the compensation voltage selection unit 702. For example, the compensation voltage selection unit 702 may store compensation data reflecting the latest information.

To update the compensation voltage, the compensation voltage update unit 701 receives the maximum voltage Vmax from the maximum voltage detection unit 150 and receives the highest gray level image data signal Gmax from the timing controller 101. The compensation voltage update unit 701 corrects at least one of the compensation voltages based on the maximum voltage Vmax. For example, the compensation voltage update unit 701 corrects a compensation voltage having substantially the same gray level as a gray level of the highest gray level image data signal Gmax. To be more specific, in the case where the highest gray level image data signal detected in a predetermined horizontal period is an image data signal of a gray level 100, the compensation voltage update unit 701 selects a compensation voltage of a gray level 100 among the stored 256 compensation voltages (e.g., compensation voltages from a gray level 0 to a gray level 255) and corrects the compensation voltage of a gray level 100. In this case, the compensation voltage update unit 701 may perform the correcting operation by replacing the compensation voltage of a gray level 100 with a maximum voltage Vmax detected in the predetermined horizontal period. Accordingly, the compensation voltages stored in the compensation voltage selection unit 702 may have different values as time elapses. In other words, the compensation voltages stored in the compensation voltage selection unit 702 may have different values over time.

In an exemplary embodiment of the present invention, the compensation voltage update unit 701 may further correct at least one of other compensation voltages stored in the compensation voltage selection unit 702 based on an amount of change in the compensation voltage corrected based on the maximum voltage Vmax. For example, in the case where the compensation voltage of a gray level 100 is changed to the maximum voltage Vmax detected in the aforementioned predetermined horizontal period as described above, the compensation voltage update unit 701 calculates an amount of change in the compensation voltage of a gray level 100. In the case where the compensation voltage of a gray level 100 before the correction has a value of about 10 V and the compensation voltage of a gray level 100 after the correction has a value of about 15 V, a voltage variation rate is +50%. In this case, the compensation voltage update unit 701 may correct at least one of other compensation voltages of other gray levels to a voltage 50% greater than the at least one of the other compensation voltages.

The compensation voltage update unit 701 may periodically correct the compensation voltages stored in the compensation voltage selection unit 702 at every y-th horizontal period, wherein y is a natural number. To accomplish this, the compensation voltage update unit 701 may include a counter.

The counter counts the highest gray level image data signals Gmax input to the compensation voltage update unit 701 in each horizontal period, and generates an output when the number of the counted highest gray level image data signals Gmax reaches a preset value "y." In response to the output from the counter, the compensation voltage update unit 701 performs the above-described correcting operation based on the maximum voltage Vmax detected in a horizontal period in which the output is generated.

In an exemplary embodiment of the present invention, after the output is generated, the counter is reset and starts counting the highest gray level image data signals Gmax from the beginning.

In the case where y is sufficiently large, the compensation voltage update unit 701 may perform the correcting operation as described above on a frame basis.

As described above, in the case where a voltage of the feedback line FL does not reach a target voltage (e.g., the maximum voltage Vmax) in one horizontal period, the maximum voltage Vmax detected by the maximum voltage detection unit 150 in the one horizontal period may not coincide with the maximum voltage Vmax in said one horizontal period. This is because the voltage is detected in a state where the feedback line FL is not sufficiently charged to the target voltage (e.g., the maximum voltage Vmax).

The compensation voltage output unit 700 outputs the compensation voltage Vc based on the gray level of the highest gray level image data signal Gmax, and thus, may almost always directly output the maximum voltage Vmax (e.g., the compensation voltage Vc) having a normal level to the power supply unit 140, regardless of the charging time of the feedback line FL. In other words, since the compensation voltages depending on the gray level of the highest gray level image data signal Gmax are stored in advance in the compensation voltage selection unit 702, the compensation voltage output unit 700 may provide the compensation voltage Vc to the power supply unit 140 according to the highest gray level image data signal Gmax applied to the compensation voltage output unit 700 in each horizontal period.

However, since the compensation voltages stored in the compensation voltage selection unit 702 are corrected based on the maximum voltage Vmax detected from the feedback line FL, the charging time of the feedback line FL may become long. Accordingly, in the case where substantially all of the pixels receive an image data signal of a gray level 0 as described above, the compensation voltage selection unit 702 does not have to correct the compensation voltages.

For example, in the case where the number of image data signals having a lower gray level than a preset reference gray level among image data signals of all of the pixels PX included in a screen data in each horizontal period exceeds a preset threshold value, the timing controller 101 further outputs a holding signal HS. The holding signal HS is applied to the compensation voltage update unit 701.

The compensation voltage update unit 701 that receives the holding signal HS does not correct the compensation voltages although the highest gray level image data signal Gmax is input in the corresponding horizontal period. In other words, in response to the holding signal HS, the compensation voltage update unit 701 maintains the compensation voltages of the compensation voltage selection unit 702 to a value before the generation of the highest gray level image data signal Gmax, regardless of the input of the highest gray level image data signal Gmax.

Accordingly, the high electric potential driving voltage ELVDD output from the power supply unit 140 may properly vary in accordance with a level of the maximum voltage Vmax which is almost always correct in each horizontal period.

Figure 19:
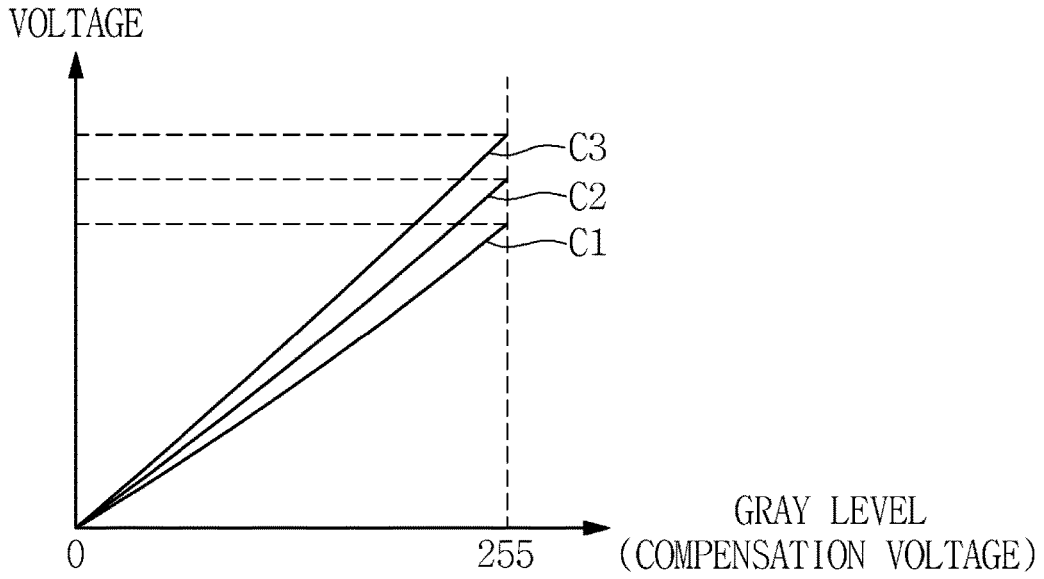
FIG. 19 is an explanatory view illustrating a time-dependent variation of compensation voltages stored in a compensation voltage selection unit of FIG. 18 according to an exemplary embodiment of the present invention.

FIG. 19 is an explanatory view illustrating a time-dependent variation of compensation voltages stored in the compensation voltage selection unit 702 of FIG. 18 according to an exemplary embodiment of the present invention.

Each of curves C1, C2 and C3 illustrated in FIG. 19 is a curve representing a level of a compensation voltage depending on a gray level.

Each of the curves C1, C2, and C3 represents the level of 256 compensation voltages from a gray level 0 to a gray level 255. As a gray level of a compensation voltage increases, a voltage level of the compensation voltage increases.

For example, a first curve C1 represents 256 correction voltages that are corrected based on a maximum voltage Vmax detected in an (x−2)-th horizontal period, a second curve C2 represents 256 correction voltages that are corrected based on a maximum voltage Vmax detected in an (x−1)-th horizontal period, and a third curve C3 represents 256 correction voltages that are corrected based on a maximum voltage Vmax detected in an x-th horizontal period, wherein x is natural number greater than 2.

As illustrated in FIG. 19, a level of a compensation voltage of a gray level 255 may be different from one time to another. For example, a compensation voltage of a gray level 255 in the third curve C3 may have a greater value than a value of a compensation voltage of a gray level 255 in the first curve C1.

Figure 20:
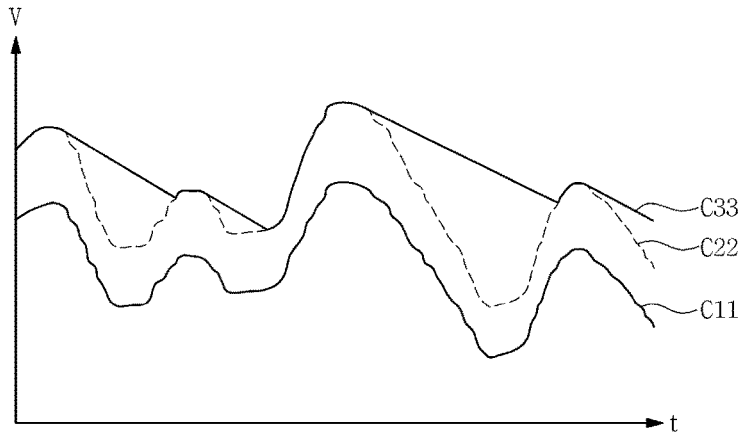
FIG. 20 is an explanatory view illustrating a variation of a high electric potential driving voltage by the compensation value output unit of FIG. 16 according to an exemplary embodiment of the present invention.

FIG. 20 is an explanatory view illustrating a variation of a high electric potential driving voltage ELVDD by the compensation value output unit 700 of FIG. 16 according to an exemplary embodiment of the present invention.

Each of first and second curves C11 and C22 is a curve showing a variation of a level of the maximum voltage Vmax depending on time, wherein the time refers to a horizontal period. The first and second curves C11 and C22 represent changes in the level of the maximum voltage Vmax detected in respective horizontal periods. In the graph of FIG. 20, 't' represents time and 'V' represents voltage.

As used herein, a maximum voltage Vmax in the first curve C11 denotes a voltage detected by the maximum voltage detection unit 150, and a maximum voltage Vmax in the second curve C22 denotes a maximum voltage Vmax based on the highest gray level image data signal Gmax.

The third curve C33 is a curve showing a variation of a level of the high electric potential driving voltage ELVDD depending on time, wherein time refers to a horizontal period.

As described above, in the case where a voltage of the feedback line FL does not reach a target voltage (e.g., the maximum voltage Vmax) in one horizontal period, the first curve C11 may not coincide with the second curve C22. This is because the voltage is detected in a state where the feedback line FL is not fully charged to the target voltage (e.g., the maximum voltage Vmax).

Since the compensation voltage output unit 700 outputs a compensation voltage based on a gray level of the highest gray level image data signal Gmax, the compensation voltage output unit 700 may almost always directly output the maximum voltage Vmax (e.g., the compensation voltage Vc) having a substantially correct level to the power supply unit 140, regardless of the charging time of the feedback line FL. Accordingly, as the third curve C33, the high electric potential driving voltage ELVDD from the power supply unit 140 varies in accordance with the second curve C22, not the first curve C11. In other words, the high electric potential driving voltage ELVDD may vary in correspondence with the level of the correct maximum voltage Vmax in each horizontal period.

In an exemplary embodiment of the present invention, the light emitting display device generates a high electric potential driving voltage having a substantially minimum voltage level required for driving a display panel. Accordingly, power consumption of the display device may be reduced.

In an exemplary embodiment of the present invention, the light emitting display device corrects the high electric potential driving voltage using a voltage detected from a light emitting element. Accordingly, a detection circuit and a correction circuit may have a simple structure. As a result, resource consumption of a system may be also reduced.

In an exemplary embodiment of the present invention, the display device corrects the high electric potential driving voltage using a compensation voltage for each corresponding gray level of an image data signal. Accordingly, response speed of the high electric potential driving voltage may be fast.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A light emitting display device, comprising:

a display panel including a plurality of pixels, each of the plurality of pixels comprising a driving switching element connected to a first power line and a light emitting element connected to a second power line;

a maximum voltage detection unit for detecting a voltage from each of the light emitting elements of each of the pixels and outputting a maximum voltage that has a highest voltage level among the detected voltages; and a power supply unit for correcting a first driving voltage based on the maximum voltage and applying the corrected first driving voltage to the first power line, wherein the maximum voltage detection unit comprises a plurality of diode-type elements, a first terminal and a second terminal of each of the plurality of diode-type elements are connected to each other and a corresponding one of the light emitting elements, and a third terminal of each of the plurality of diode-type elements is connected in common to a feedback input terminal of the power supply unit, the maximum voltage being applied to the feedback input terminal, and the feedback input terminal is connected to the second power-line.

2. The light emitting display device as claimed in claim 1, wherein the maximum voltage detection unit further comprises a resistor connected between the feedback input terminal and the second power line.

3. The light emitting display device as claimed in claim 1, wherein at least one of the diode-type elements is a diode-type transistor.

4. The light emitting display device as claimed in claim 1, wherein the power supply unit decreases the first driving voltage as the maximum voltage decreases.

5. The light emitting display device as claimed in claim 1, wherein the power supply unit corrects the first driving voltage so that a difference voltage between the first driving voltage and a second driving voltage of the second power line is substantially equal to a sum of the maximum voltage and a minimum drain-source voltage of a driving switching element.

6. A light emitting display device, comprising:

a plurality of first pixels in a first display area of a display panel, each of the plurality of first pixels comprising a first driving switching element connected to a first power line and a first light emitting element connected to a second power line;

a first maximum voltage detection unit for detecting a voltage from each of the first light emitting elements of each of the first pixels and outputting a first maximum voltage that has a highest voltage level among the detected voltages;

a first power supply unit for correcting a first driving voltage based on the first maximum voltage and applying the corrected first driving voltage to the first power line;

a plurality of second pixels in a second display area of the display panel, each of the plurality of second pixels comprising a second driving switching element connected to a third power line and a second light emitting element connected to the second power line;

a second maximum voltage detection unit for detecting a voltage from each of the second light emitting elements of each of the second pixels and outputting a second maximum voltage that has a highest voltage level among the detected voltages; and a second power supply unit for correcting a third driving voltage based on the second maximum voltage and applying the corrected third driving voltage to the third power line, wherein the first maximum voltage detection unit comprises:

a first resistor connected between a first feedback input terminal of the first power supply unit and the second power line, the first maximum voltage being input to the first feedback input terminal; and a first diode-type element connected between each one of the first light emitting elements of the first pixels and the first resistor, and a first terminal of each of the first diode-type elements is individually connected to a corresponding one of the first light emitting elements of the first pixels, and a second terminal of each of the first diode-type elements is connected in common to the first feedback input terminal.

7. The light emitting display device as claimed in claim 6, wherein the second maximum voltage detection unit comprises:

a second resistor connected between a second feedback input terminal of the second power supply unit and the second power line, the second maximum voltage being input to the second feedback input terminal; and a second diode-type element connected between each one of the second light emitting elements of the second pixels and the second resistor, and a first terminal of each of the second diode-type elements is individually connected to a corresponding one of the second light emitting elements of the second pixels, and a second terminal of each of the second diode-type elements is connected in common to the second feedback input terminal.

8. The light emitting display device as claimed in claim 6, wherein the first power supply unit corrects the first driving voltage so that a difference voltage between the first driving voltage and a second driving voltage of the second power line is substantially equal to a sum of the first maximum voltage and a minimum drain-source voltage of a first driving switching element, and the second power supply unit corrects the third driving voltage so that a difference voltage between the second driving voltage and the third driving voltage is substantially equal to a sum of the second maximum voltage and a minimum drain-source voltage of a second driving switching element.

9. The light emitting display device as claimed in claim 6, wherein the first light emitting elements comprise at least two of a red light emitting element, a green light emitting element, a blue light emitting element, and a white light emitting element.

10. The light emitting display device as claimed in claim 6, wherein the second light emitting elements comprise at least two of a red light emitting element, a green light emitting element, a blue light emitting element, and a white light emitting element.

11. A light emitting display device, comprising:

a display panel;

a plurality of first pixels disposed in the display panel, each of the plurality of first pixels comprising a first driving switching element connected to a first power line and a first light emitting element connected to a second power line;

a first maximum voltage detection unit for detecting a voltage from each of the first light emitting elements of each of the first pixels and outputting a first maximum voltage that has a highest voltage level among the detected voltages;

a first power supply unit for correcting a first driving voltage based on the first maximum voltage and applying the corrected first driving voltage to the first power line;

a plurality of second pixels disposed in the display panel, each of the plurality of second pixels comprising a second driving switching element connected to a third power line and a second light emitting element connected to the second power line;

a second maximum voltage detection unit for detecting a voltage from each of the second light emitting elements of each of the second pixels and outputting a second maximum voltage that has a highest voltage level among the detected voltages; and a second power supply unit for correcting a third driving voltage based on the second maximum voltage and applying the corrected third driving voltage to the third power line, wherein the first light emitting element emits a light having a color different from a color of a light emitted from the second light emitting element, wherein the first maximum voltage detection unit comprises:

a first resistor connected between a first feedback input terminal of the first power supply unit and the second power line, the first maximum voltage being input to the first feedback input terminal; and a first diode-type element connected between each one of the first light emitting elements of the first pixels and the first resistor, and a first terminal of each of the first diode-type elements is individually connected to a corresponding one of the first light emitting elements of the first pixels, and a second terminal of each of the first diode-type elements is connected in common to the first feedback input terminal.

12. The light emitting display device as claimed in claim 11, wherein the second maximum voltage detection unit comprises:

a second resistor connected between a second feedback input terminal of the second power supply unit and the second power line, the second maximum voltage being input to the second feedback input terminal; and a second diode-type element connected between each one of the second light emitting elements of the second pixels and the second resistor, and a first terminal of each of the second diode-type elements is individually connected to a corresponding one of the second light emitting elements of the second pixels, and a second terminal of each of the second diode-type elements is connected in common to the second feedback input terminal.

13. The light emitting display device as claimed in claim 11, wherein the first power supply unit corrects the first driving voltage so that a difference voltage between the first driving voltage and a second driving voltage of the second power line is substantially equal to a sun of the first maximum voltage and a minimum drain-source voltage of a first driving switching element, and the second power supply unit corrects the third driving voltage so that a difference voltage between the second driving voltage and the third driving voltage is substantially equal to a sum of the second maximum voltage and a minimum drain-source voltage of a second driving switching element.

14. The light emitting display device as claimed in claim 11, wherein the first light emitting elements comprise at least one of a red light emitting element, a green light emitting element, a blue light emitting element, and a white light emitting element.

15. The light emitting display device as claimed in claim 11, wherein the second light emitting elements comprise at least one of a red light emitting element, a green light emitting element, a blue light emitting element, and a white light emitting element.

16. A light emitting display device, comprising:

a display panel including a plurality of pixels, each of the plurality of pixels comprising a driving switching element connected to a first power line and a light emitting element connected to a second power line;

a maximum voltage detection unit for detecting a voltage from each of the light emitting elements of each of the pixels and outputting a maximum voltage that has a highest voltage level among the detected voltages;

a timing controller for outputting a highest gray level image data signal having a highest gray level among image data signals applied to the plurality of pixels;

a compensation voltage selection unit for storing compensation voltages corresponding to respective gray levels of a plurality of image data signals and selecting a compensation voltage corresponding to the highest gray level image data signal;

a compensation voltage update unit for correcting the compensation voltage of the compensation voltage selection unit corresponding to the highest gray level image data signal based on the maximum voltage; and a power supply unit for correcting a first driving voltage based on the compensation voltage selected by the compensation voltage selection unit and applying the corrected first driving voltage to the first power line, wherein, when the number of image data signals having a lower gray level than a reference gray level among the image data signals applied to the plurality of pixels exceeds a threshold value, the timing controller further generates a holding signal and applies the holding signal to the compensation voltage update unit.

17. The light emitting display device as claimed in claim 16, wherein the compensation voltage update unit further corrects at least one other compensation voltage stored in the compensation voltage selection unit based on a variation amount of the compensation voltage corrected according to the maximum voltage.

18. The light emitting display device as claimed in claim 16, wherein, in response to the holding signal, the compensation voltage update unit maintains the compensation voltages of the compensation voltage selection unit to keep values they had before the generation of the highest gray level image data signal, regardless of an input of the highest gray level image data signal.

19. The light emitting display device as claimed in claim 16, wherein the compensation voltage update unit corrects the compensation voltage once every y-th horizontal period, wherein y is a natural number greater than 2.

20. The light emitting display device as claimed in claim 16, wherein the maximum voltage detection unit comprises:

a resistor connected between a feedback input terminal of the compensation voltage update unit and the second power line, the maximum voltage being input to the feedback input terminal; and a diode-type element connected between each one of the light emitting elements and the resistor, and a first terminal of each of the diode-type elements is individually connected to a corresponding one of the light emitting elements, and a second terminal of each of the diode-type elements is connected in common to the feedback input terminal.

21. The light emitting display device as claimed in claim 16, wherein the power supply unit corrects the first driving voltage so that a difference voltage between the first driving voltage and a second driving voltage of the second power line is substantially equal to a sum of the selected compensation voltage and a minimum drain-source voltage of a driving switching element.

22. The light emitting display device as claimed in claim 16, wherein the compensation voltage selection unit is a look-up table.

23. A light emitting display device, comprising:

a display panel comprising a plurality of pixels, each of the plurality of pixels comprising a driving switching element connected to a first power line and a light emitting element connected to a second power line;

a power supply unit for applying a power to the first power line; and a diode directly connected to an anode electrode of the light emitting element disposed in at least one pixel, a driving transistor of the at least one pixel, and a feedback input terminal of the power supply unit, wherein a resistor is connected between the diode and the second power line.

* * * * *